US011649133B2

(12) United States Patent
Sato

(10) Patent No.: US 11,649,133 B2
(45) Date of Patent: May 16, 2023

(54) SHEET POST-PROCESSING APPARATUS

(71) Applicant: CANON KABUSHIKI KAISHA, Tokyo (JP)

(72) Inventor: Kazuhisa Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/553,952

(22) Filed: Dec. 17, 2021

(65) Prior Publication Data

US 2022/0204303 A1 Jun. 30, 2022

(30) Foreign Application Priority Data

Dec. 25, 2020 (JP) ..... JP2020-217249

(51) Int. Cl.

| | |
|---|---|
| ***B65H 33/08*** | (2006.01) |
| ***B65H 31/34*** | (2006.01) |
| ***G03G 15/00*** | (2006.01) |
| ***B65H 35/00*** | (2006.01) |

(52) U.S. Cl.

CPC ..... *B65H 33/08* (2013.01); *B65H 31/34* (2013.01); *B65H 35/00* (2013.01); *G03G 15/6541* (2013.01); *B65H 2301/34* (2013.01)

(58) Field of Classification Search

CPC ..... B65H 31/34; B65H 33/08; B65H 35/00; B65H 2301/34; B65H 2301/333; B65H 2301/3331; B65H 2301/33314; B65H 2301/3613; G03G 15/6541; G03G 15/6582; G03G 2215/00818; B26F 1/00

USPC ..... 270/58.07; 271/186, 225, 285, 286

See application file for complete search history.

(56) References Cited

U.S. PATENT DOCUMENTS

| | | | | |
|---|---|---|---|---|
| 6,205,297 | B1 | 3/2001 | Tachibana et al. | |
| 6,264,194 | B1 * | 7/2001 | Hayashi | B65H 31/3027 271/220 |
| 6,305,262 | B1 * | 10/2001 | Watanabe | B26D 5/32 83/687 |
| 6,540,418 | B1 | 4/2003 | Sato | |
| 6,783,124 | B2 * | 8/2004 | Tamura | B26D 7/2628 83/73 |
| 7,055,815 | B2 | 6/2006 | Sato et al. | |
| 7,134,659 | B2 | 11/2006 | Sato et al. | |
| 7,905,476 | B2 * | 3/2011 | Haramiishi | B42B 5/08 270/58.08 |

(Continued)

FOREIGN PATENT DOCUMENTS

| | | | |
|---|---|---|---|
| JP | 2002012361 A | * | 1/2002 |
| JP | 2017-197314 A | | 11/2017 |

*Primary Examiner* — Leslie A Nicholson, III

(74) *Attorney, Agent, or Firm* — Venable LLP

(57) ABSTRACT

A sheet post-processing apparatus that performs post-processing on a sheet on which an image is formed includes: a punch hole forming portion; and a sheet bundle forming portion that has a conveyance portion, stops a first sheet on a conveyance path, and conveys a second sheet after the first sheet to a position overlapping the first sheet to form a sheet bundle. The sheet post-processing apparatus includes a shift portion to make a shift so that a relative position between the first sheet and the second sheet in a direction orthogonal to a conveyance direction becomes a relative position at which the second sheet does not overlap a punch hole of the first sheet to make the second sheet overlap the first sheet, and forms a sheet bundle in which sheets overlapped with each other are deviated in a width direction.

9 Claims, 21 Drawing Sheets

(56) References Cited

U.S. PATENT DOCUMENTS

| | | | | |
|---|---|---|---|---|
| 7,975,999 | B2 * | 7/2011 | Fukasawa | B65H 45/18 270/32 |
| 8,308,154 | B2 * | 11/2012 | Miyake | G03G 15/6544 270/58.12 |
| 8,454,012 | B2 * | 6/2013 | Obuchi | G03G 15/6547 271/228 |
| 8,678,367 | B2 * | 3/2014 | Shimakawa | B65H 31/10 270/58.09 |
| 9,602,690 | B2 | 3/2017 | Yokoyama et al. | |
| 9,933,743 | B2 | 4/2018 | Takahashi et al. | |
| 10,322,902 | B2 * | 6/2019 | Nakano | B65H 45/18 |

* cited by examiner

SHEET POST-PROCESSING APPARATUS

BACKGROUND OF THE INVENTION

Field of the Invention

The present invention relates to a sheet post-processing apparatus that performs post-processing such as punch hole forming processing and binding processing on a sheet on which an image is formed by an image forming apparatus such as a copier, a printing machine, and a laser beam printer.

Description of the Related Art

In recent years, known sheet post-processing apparatuses cause a sheet on which an image is formed by an image forming apparatus such as a copier and a laser beam printer to invert (switchback) in a conveyance path to make a preceding sheet and a following sheet overlap each other to form a sheet bundle of a plurality of sheets and perform prescribed post-processing. Examples of the post-processing include binding processing to perform binding with a staple, punch processing to form a boring hole (punch hole) with a boring apparatus (punch hole forming apparatus), sort processing to perform a sorting operation, or the like. As shown in Japanese Patent Application Laid-open No. 2017-197314, a sheet post-processing apparatus that forms a punch hole along an end edge extending in a sheet conveyance direction in which a sheet is vertically conveyed has been put on the market in recent years.

SUMMARY OF THE INVENTION

If a following sheet in which a protruding curl is caused is conveyed to a punch hole of a preceding sheet when a sheet bundle is formed by sheets on which a punch hole is formed as shown in Japanese Patent Application Laid-open No. 2017-197314, there is a possibility that the corner portion of the leading end of the following sheet gets snagged on the punch hole. At this time, the subsequent snagged sheet repels with a repulsive force due to its stiffness and may cause the pushing out or skewing of the preceding sheet. If such pushing-out or skewing is caused, there is a problem that the distance of a deviation between the leading end positions of the respective sheets of a sheet bundle or a skew amount does not fall within a certain range. Therefore, the sheet bundle may not be aligned satisfactorily.

The present invention has an object of providing a technology that allows post-processing with excellent alignment in a sheet post-processing apparatus that performs punch hole forming processing on a sheet on which an image is formed and performs post processing to form a sheet bundle.

In order to achieve the above object, a sheet post-processing apparatus according to the present invention that performs post-processing on a sheet on which an image is formed by an image forming apparatus includes:

a punch hole forming portion that forms a punch hole on a sheet; and a sheet bundle forming portion that has a conveyance portion to convey a sheet on which a punch hole is formed and makes a plurality of sheets on which a punch hole is formed overlap each other to form a sheet bundle, the sheet bundle forming portion stopping a first sheet on which a punch hole is precedingly formed on a conveyance path and conveying a second sheet on which a punch hole is formed after the first sheet to a position overlapping the first sheet to form the sheet bundle, wherein the sheet bundle forming portion has a shift portion to make a shift so that a relative position between the first sheet and the second sheet in a width direction orthogonal to a conveyance direction becomes a relative position at which the second sheet does not overlap a punch hole formed on the first sheet to make the second sheet overlap the first sheet, and forms a sheet bundle in which sheets overlapped with each other are deviated in the width direction.

In order to achieve the above object, a sheet post-processing apparatus according to the present invention that performs post-processing on a sheet on which an image is formed by an image forming apparatus includes:

a punch hole forming portion that forms a punch hole on a sheet; and a sheet bundle forming portion that has a conveyance portion to convey a sheet on which a punch hole is formed and makes a plurality of sheets on which a punch hole is formed overlap each other to form a sheet bundle, the sheet bundle forming portion stopping a first sheet on which a punch hole is precedingly formed on a conveyance path and conveying a second sheet on which a punch hole is formed after the first sheet to a position overlapping the first sheet to form the sheet bundle, wherein the sheet bundle forming portion sets a stop position of the first sheet at a stop position at which the second sheet overlaps the first sheet while preventing a leading end of the second sheet from contacting a punch hole formed on the first sheet to make the second sheet overlap the first sheet.

As described above, it is possible to perform post-processing with excellent alignment in a sheet post-processing apparatus that performs punch hole forming processing on a sheet on which an image is formed and performs post-processing to form a sheet bundle.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1:
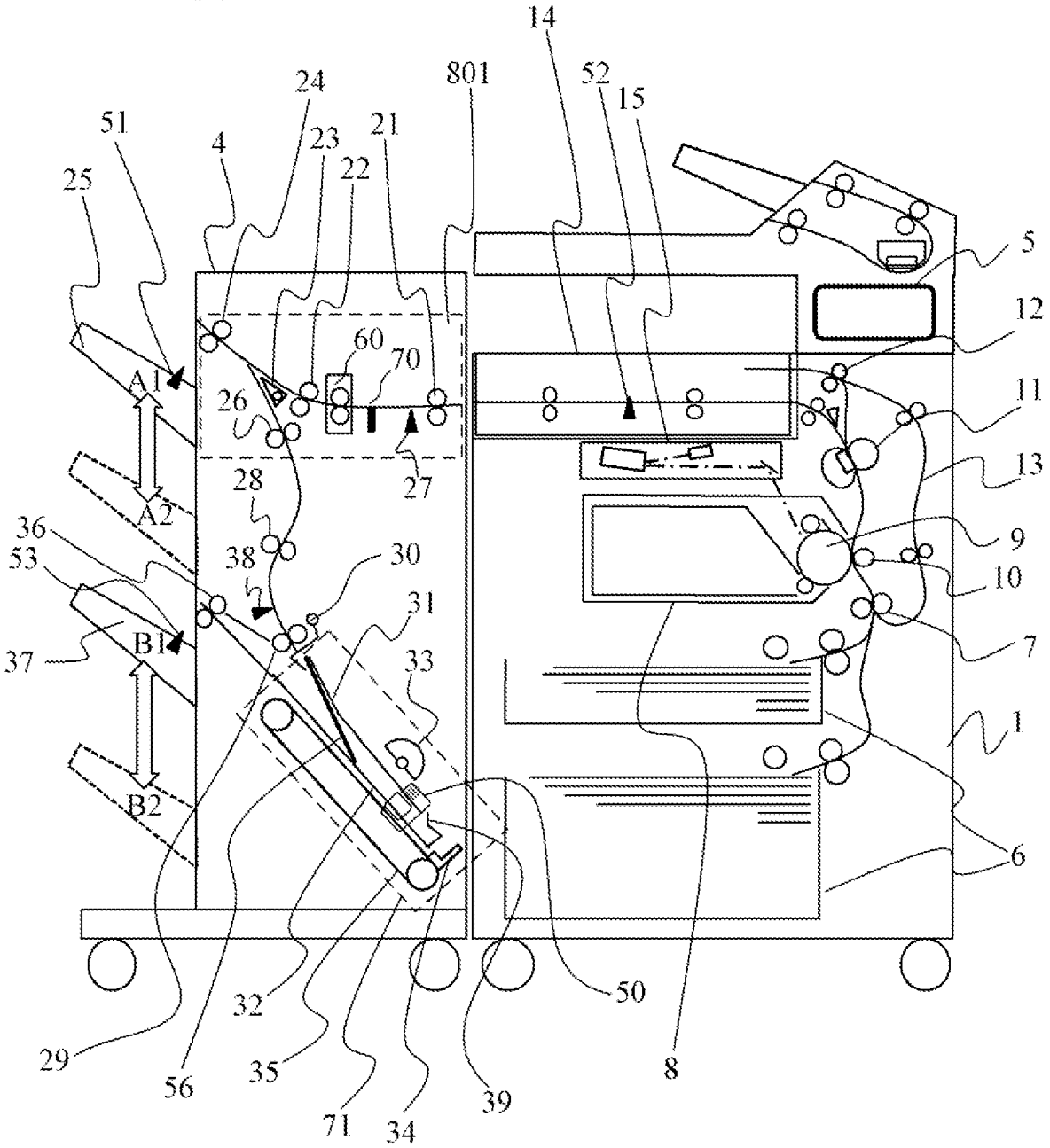
FIG. 1 is a cross-sectional view of an image forming apparatus 1 connected to a sheet post-processing apparatus according to the present invention.

FIG. 1 shows a cross-sectional view of an image forming apparatus 1 and a sheet post-processing apparatus 4 that have carried out the present invention. After the description of the simple operations of the respective apparatuses, the detailed operation of the sheet post-processing apparatus 4 will be described. The sheet post-processing apparatus 4 has a boring apparatus 60 that subjects a sheet to boring (punch hole) processing. The sheet punched by the boring apparatus 60 is caused to switchback on a conveyance path and subjected to buffer processing to overlap in which a plurality of sheets are overlapped with each other. Next, a sheet bundle formed by the buffer processing is conveyed on the conveyance path and loaded into an intermediate loading portion 71. After that, the end of the sheet bundle in a conveyance direction and the end of the sheet bundle in a direction orthogonal to the conveyance direction are aligned by alignment means inside the intermediate loading portion. Then, the sheet bundle aligned in the conveyance direction and the direction orthogonal to the conveyance direction is allowed to be pushed out from the intermediate loading portion 71 and dischargeable to an outside as it is by a bundle sheet discharging roller 36.

A plurality of sheet feeding apparatuses 6 that accommodate a plurality of sheets and feed the sheets one by one with a prescribed sheet feeding interval are connected to the image forming apparatus 1. The skew of a sheet fed from the sheet feeding apparatuses 6 is corrected by a resist roller 7 and conveyed to a photosensitive drum 9 rotatably supported by an image forming cartridge 8 and a transfer roller 10 to which prescribed charges are applied. Inside the image forming cartridge, a toner image is formed on the surface of the photosensitive drum 9 after the photosensitive drum 9 is subjected to the respective processes of exposure, charging, latent image formation, and development. The latent image formation is carried out by a laser scanner unit 15 that scans the sheet with the blinking of laser light in a conveyance direction and a perpendicular direction using a polygon mirror and a lens to perform image formation. The sheet on which a toner image is formed is fed to a horizontal conveyance portion 14 via a fixing unit 11 that fixes toner on the sheet by heating and pressing. When both sides of the sheet are to be printed, the sheet is temporarily conveyed to an inversion roller 12, fed to a sheet re-feeding conveyance portion 13 after being subjected to switchback conveyance to switch the leading end and the rear end of the sheet, and conveyed to the resist roller 7 again at a prescribed timing to be subjected to image formation for the second time.

On the other hand, the sheet conveyed from the horizontal conveyance portion 14 is delivered to the sheet post-processing apparatus 4 by an entrance roller 21 of the sheet post-processing apparatus 4. In order to absorb a difference in conveyance speed between a conveyance speed inside the sheet post-processing apparatus 4 and a conveyance speed inside the horizontal conveyance portion 14, a one-way clutch (not shown) is embedded in a driving portion (not shown).

When the discharging destination of the sheet is a sheet discharging upper tray 25 that is a first sheet discharging port, the sheet on which an image is formed is subjected to boring processing and then conveyed on the conveyance path. The leading end of the sheet is delivered from a pre-buffer roller 22 to a sheet discharging inversion roller 24. The sheet is discharged to the sheet discharging upper tray 25 without being caused to switchback. At this discharging destination, the sheet is not subjected to buffer processing in which a sheet bundle is formed.

Figure 3:
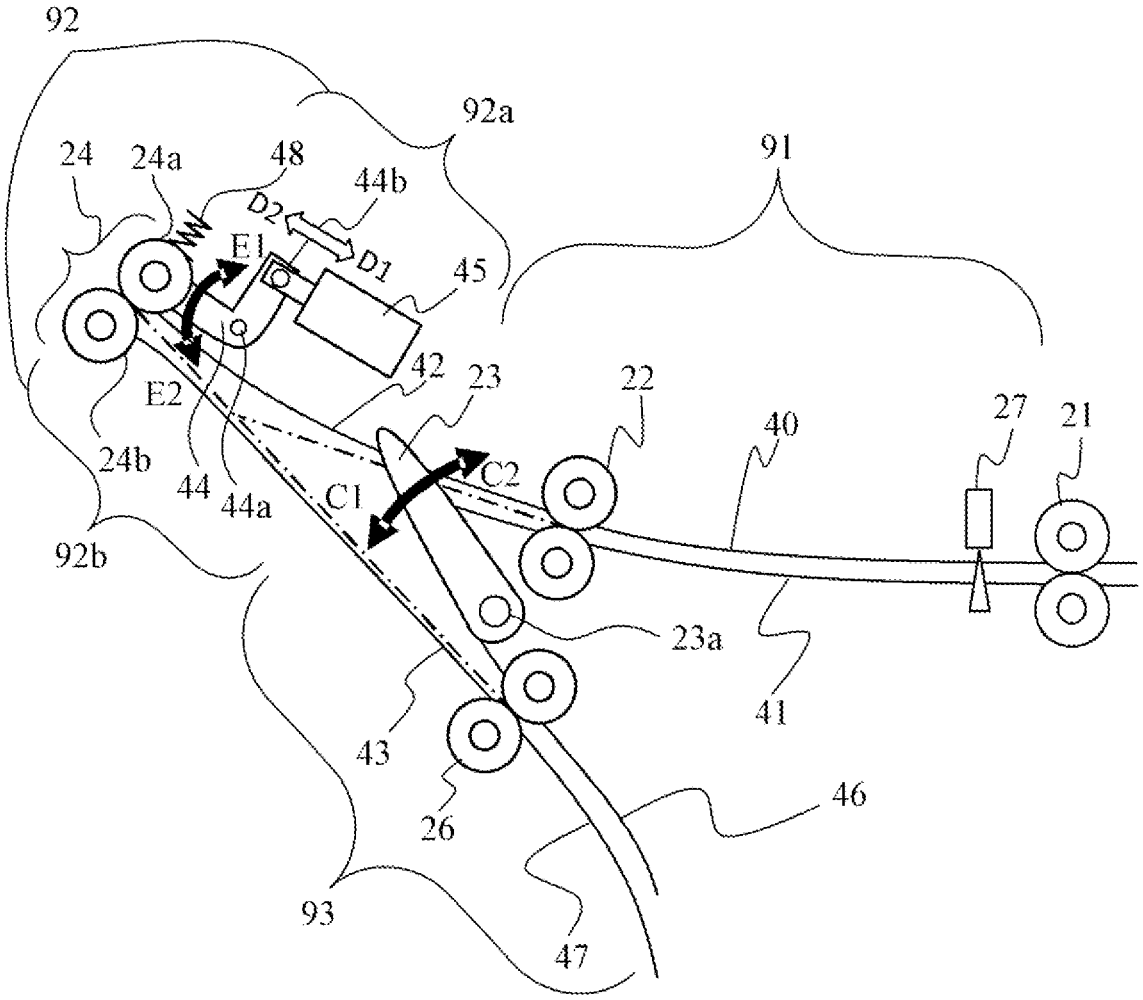
FIG. 3 is a cross-sectional view of a buffer portion according to the present invention.

Next, the buffer processing of a sheet performed when the discharging destination of the sheet is a sheet discharging lower tray 37 that is a second sheet discharging port will be described using FIG. 3. The sheet is conveyed from the entrance roller 21 via the pre-buffer roller 22, and the rear end of the sheet passes through a backflow prevention valve 23 that is urged in a clockwise direction in FIG. 3 by a spring (not shown). A conveyance path through which the sheet passes at this time is defined as a first conveyance path 91. The backflow prevention valve 23 plays a role in preventing the sheet that is caused to switchback from being conveyed to the first conveyance path again. Then, the sheet is held by the sheet discharging inversion roller 24 at the timing, and the rotating direction of the sheet discharging inversion roller 24 is inverted after the sheet is temporarily stopped. When the sheet is caused to switchback, the conveyance direction of the sheet is reversed. That is, in a traveling direction in which the sheet is conveyed, the upper and lower surfaces of the sheet remain the same, but the end that served as the leading end of the sheet before the switchback serves as the rear end of the sheet after the switchback. Note that a path through which the sheet passes before the switchback and a path through which the sheet passes after the switchback after passing through the first conveyance path 91 are defined as a switchback path 92*a* and a switchback path 92*b*, respectively, and the switchback paths 92*a* and 92*b* are collectively defined as a switchback path 92.

Then, the sheet that is caused to switchback is conveyed to an inside sheet discharging roller 26. In the present embodiment, configurations relating to the switchback of a sheet such as the pre-buffer roller 22, the backflow prevention valve 23, the sheet discharging inversion roller 24, the inside sheet discharging roller 26, and the switchback path 92 correspond to switchback means according to the present invention. Note that specific configurations constituting the switchback means are not limited to the configurations shown in the present embodiment. A conveyance path through which the sheet passes after the switchback path 92 at this time is defined as a second conveyance path 93. Then, at a stage at which the leading end of the sheet reaches the inside sheet discharging roller 26, the sheet discharging inversion roller 24 cancels its nip and prepares for the reception of a following sheet directed to the sheet discharging inversion roller 24. After that, the driving of the inside sheet discharging roller 26 is temporarily stopped in a state in which the sheet is held by the inside sheet discharging roller 26. The following sheet is conveyed from the first conveyance path 91 to the switchback path 92 as described above, and the leading end of the following sheet partially overlaps so as to protrude with respect to the rear end of the preceding sheet. Then, the sheet discharging inversion roller 24 is nipped again at the timing, whereby it is possible to integrally convey the preceding sheet and the following sheet to a position at which the preceding sheet and the following sheet fall within the switchback path 92. The inside sheet discharging roller 26 conveys the preceding sheet again in an inversion direction. At the same time, the pre-buffer roller 22 conveys the following sheet. The preceding sheet conveyed in the inversion direction from the inside sheet discharging roller 26 and the following sheet conveyed from the pre-buffer roller 22 are integrally overlapped with each other as described above, whereby it is possible to perform a sheet buffer to form a sheet bundle. Further, it is possible to perform a sheet buffer of a plurality of sheets regardless of the lengths or the number of the sheets by repeatedly performing the switchback of the inside sheet discharging roller 26. In addition, in the present embodiment, configurations relating to the conveyance of a sheet such as the entrance roller 21, the pre-buffer roller 22, the sheet discharging inversion roller 24, the inside sheet discharging roller 26, the first conveyance path 91, the switchback path 92, and the second conveyance path 93 correspond to conveyance means according to the present invention. Note that specific configurations constituting the conveyance means are not limited to the configurations shown in the present embodiment. Moreover, in the present embodiment, configurations relating to the overlap of a sheet such as the entrance roller 21, the pre-buffer roller 22, the backflow prevention valve 23, the sheet discharging inversion roller 24, the inside sheet discharging roller 26, the first conveyance path 91, the switchback path 92, and the second conveyance path 93 correspond to sheet bundle forming means according to the present invention. Note that specific configurations constituting the sheet bundle forming means are not limited to the configurations shown in the present embodiment.

After the sheet buffer, the sheet conveyed from the inside sheet discharging roller 26 is fed to a kicking-out roller 29 via an intermediate conveyance roller 28 on the conveyance path and conveyed to the intermediate loading portion 71 including an intermediate loading upper guide 31 and an intermediate loading lower guide 32. A longitudinal alignment reference plate 39 is arranged on the most downstream side of the intermediate loading portion 71. The longitudinal alignment of a sheet bundle is performed in such a manner that the end of the sheet in the conveyance direction is abutted on the longitudinal alignment reference plate 39. Further, a flexible pressing guide 56 is fixed to the intermediate loading upper guide 31 and contacts a sheet inside the intermediate loading portion 71 with a prescribed pressing force. Further, a half-moon roller 33 (pressing member) having a contact portion that conveys a sheet passing through the kicking-out roller 29 to the longitudinal alignment reference plate 39 is rotatably supported by the intermediate loading upper guide 31 on the downstream side of the pressing guide 56. As alignment means for aligning a sheet bundle in the conveyance direction, the half-moon roller 33 conveys a conveyed sheet of the sheet bundle after the rear end of the conveyed sheet passes through an intermediate loading front sensor 38. The half-moon roller 33 rotates while causing its contact portion that is a part of the half-moon roller 33 to contact the sheet bundle in order from the sheet of the lowermost surface of the sheet bundle at a prescribed timing. Thus, a conveyance force toward the longitudinal alignment reference plate 39 is applied in order from the sheet of the lowermost surface of the sheet bundle, the sheets of the sheet bundle sequentially contact the longitudinal alignment reference plate 39, and the end of the sheet bundle is aligned. Note that as previously described in the mechanism of the buffer portion, the sheets of the sheet bundle are overlapped with each other from below in order of their conveyance to form the sheet bundle. Further, the conveyance pressure of the half-moon roller 33 is adjusted so that the half-moon roller 33 slips on the sheets after the sheets contact the longitudinal alignment reference plate 39. In addition, on the downstream side of the kicking-out roller 29, a bundle pressing flag 30 that suppresses the lift of the rear end of a sheet to prevent interference between the rear end of a sheet loaded into the intermediate loading portion 71 and the leading end of a following sheet is rotatably supported. The lower surface of the bundle pressing flag 30 presses the upper surface of the rear end of a sheet previously discharged into the intermediate loading portion 71 and has the function of causing the leading end of a sheet subsequently discharged by the kicking-out roller 29 to pass through a place above the rear end of the previously-discharged sheet.

Figure 19A:
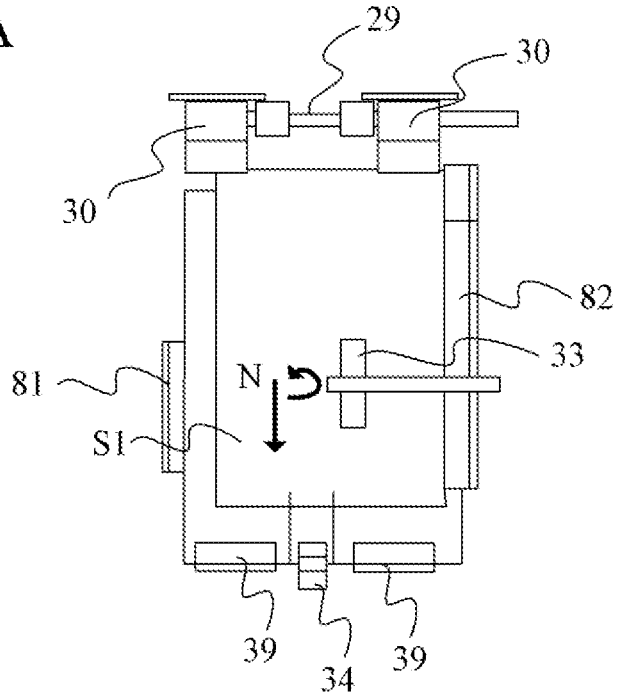
FIGS. 19A and 19B are views showing the state of an intermediate loading portion 71 according to the present invention when seen from the upper surface of a sheet.
Figure 19B:
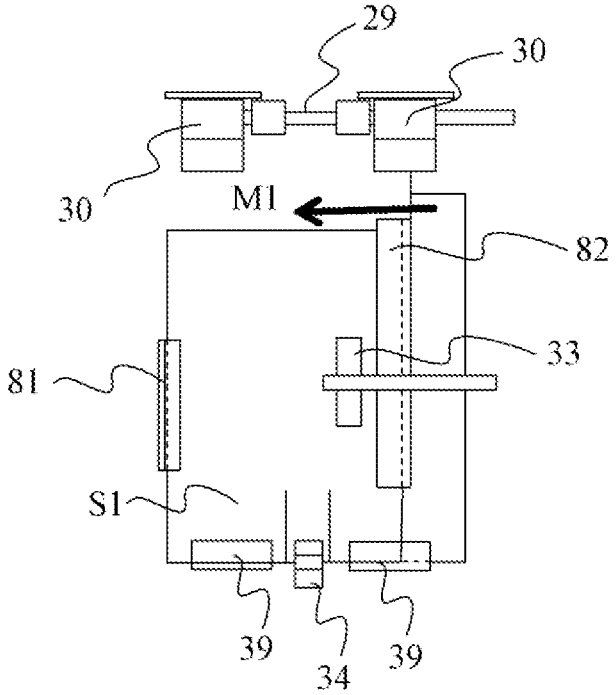

Further, FIGS. 19A and 19B show views of the intermediate loading portion 71 when seen from the upper surface of a sheet. In order to align the ends of the sheets in a direction (transverse direction) orthogonal to the conveyance direction of a sheet bundle, the intermediate loading lower guide 32 is provided with a fixed transverse alignment reference plate 81 and a transverse alignment jogger 82 movable in a sheet width direction with respect to the transverse alignment reference plate. As shown in FIG. 19A, a sheet S1 is separated from the kicking-out roller 29 and conveyed in an N direction by the rotation of the half-moon roller 33. After that, the transverse alignment jogger 82 moves in an M1 direction that is a direction toward the transverse alignment reference plate 81. Thus, as shown in FIG. 19B, the end (lateral end) of the sheet S1 in the direction (transverse direction) orthogonal to the conveyance direction of the sheet bundle is abutted on the transverse alignment reference plate 81, whereby the transverse position of the sheet S1 is aligned (sheet bundle transverse alignment means).

After the alignment of a prescribed number of sheets is finished in the manner described above, a binding operation is performed by a stapler (not shown) and a sheet bundle is pushed out when a bundle sheet discharging guide 34 connected to a guide driving portion 35 moves in parallel in the direction of the bundle sheet discharging roller 36 from a standby position. At a stage at which the leading end of the sheet bundle reaches the bundle sheet discharging roller 36, the bundle sheet discharging guide 34 stops and returns to the standby position again. The bundle sheet discharging roller 36 discharges the sheet bundle received from the bundle sheet discharging guide 34 to the sheet discharging lower tray 37. Then, the sheet discharging upper tray 25 and the sheet discharging lower tray 37 sequentially detect the positions of sheet surfaces with a sheet surface detection sensor (not shown) and move in an A2 direction and a B2 direction, respectively, when sheets are piled up.

Figures 2A, 2B, 2C, 2D:
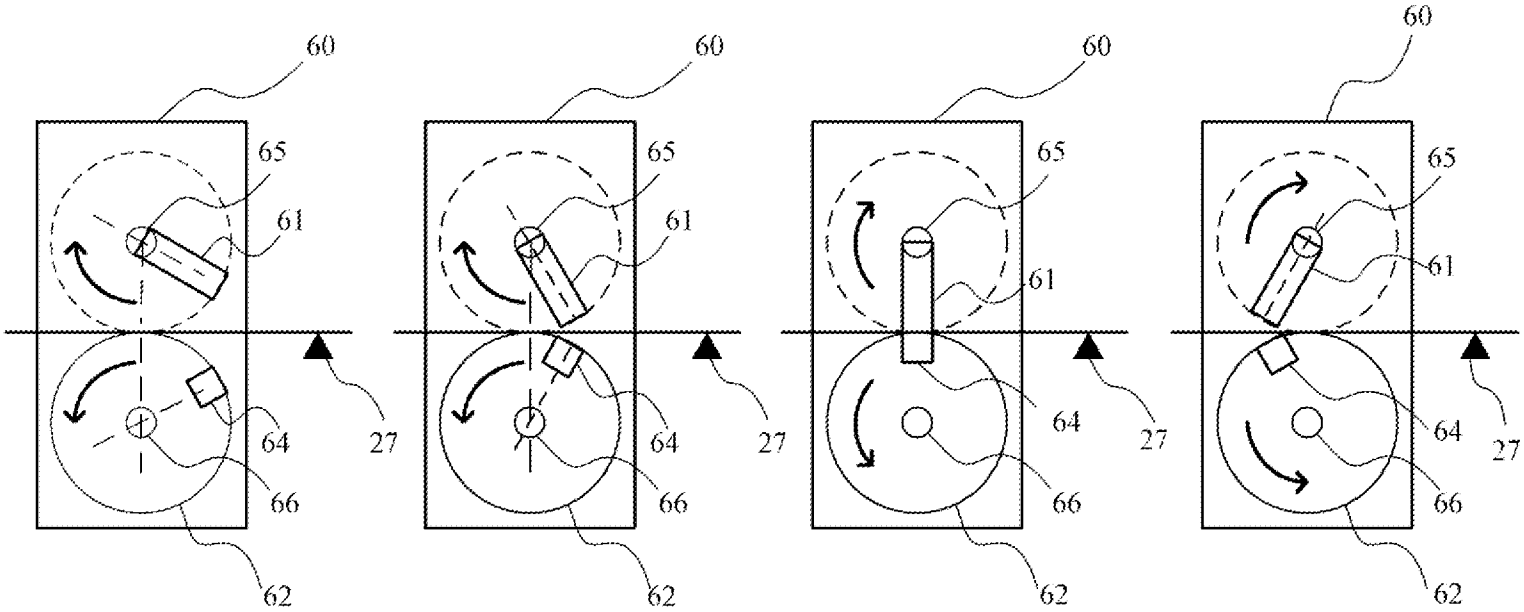
FIGS. 2A to 2D are schematic views of the boring apparatus of the sheet post-processing apparatus according to the present invention.

Next, the boring apparatus 60 will be described in detail using FIGS. 2A to 2D. The boring apparatus 60 is a rotary-type boring apparatus that bores a sheet with a rotating punch 61. As shown in FIG. 2A, the boring apparatus 60 has the punch 61 that is rotatably supported about a punch shaft 65 and a dice 62 that rotates about a dice shaft 66. An entrance sensor 27 is arranged on the upstream side of the boring apparatus 60 on the conveyance path. The dice 62 has a dice hole 64 capable of meshing with the punch 61, and the punch shaft 65 and the dice shaft 66 are driven by a punch motor 646 and mesh with gears (not shown). When the punch motor 646 serving as a driving source rotates, the punch 61 rotates in a clockwise direction shown by an arrow and the dice 62 rotates in a counterclockwise direction in FIG. 2A. FIG. 2A is a schematic view showing a state in which the punch 61 is on standby at a home position that is a previously-set position before boring starts. The punch 61 and the dice 62 are controlled to be located at the home position when an image forming job for forming an image on a sheet starts and ends. Further, the punch 61 and the dice 62 are also located at the home position during a period in which no job is input and during a job performed without a punch. When located at the home position, the punch 61 and the dice 62 are arranged so as not to hinder the conveyance of a sheet. FIG. 2B is a view showing a state in which the punch 61 has rotated to a position at which the punch 61 contacts a sheet. At the position, the boring of the sheet starts. FIG. 2C is a schematic view showing the punch 61 and the dice 62 placed at a meshing position. When the punch 61 and the dice 62 are located at the meshing position, the punch 61 meshes with the dice hole 64 of the dice 62 to bore the sheet. FIG. 2D is a schematic view showing the punch 61 and the dice 62 located at a boring end position. At this position, the punch 61 separates from the sheet.

As described above, the punch 61 is on standby at the home position until a sheet is conveyed. After that, on the basis of the fact that the entrance sensor 27 has detected the leading end of the sheet, the rotational driving of the punch shaft 65 and the dice shaft 66 is started at a prescribed timing by the punch motor 646, and the boring of the sheet is made possible while the conveyance of the sheet is continued without stopping the sheet.

When a plurality of holes are bored on a sheet, the punch 61 and the dice 62 continue their rotation to repeatedly perform the operations of FIGS. 2A to 2D again by the number of the holes. An interval at which the punch 61 rotates from the position shown in FIG. 2D to the position shown in FIG. 2A is an interval at which the punch 61 does not contact a sheet, and the punch 61 and the dice 62 are allowed to rotate at any speed. By controlling the rotation speeds of the punch 61 and the dice 62 and adjusting the time of the rotational movement of the punch 61 and the dice 62, it is possible to achieve a standard in which a distance between boring is required, e.g., 80 mm or 108 mm. Thus, a rotary-type boring apparatus is allowed to perform boring processing complying with various standards according to the destination of the apparatus without replacing a punch.

Figure 4A:
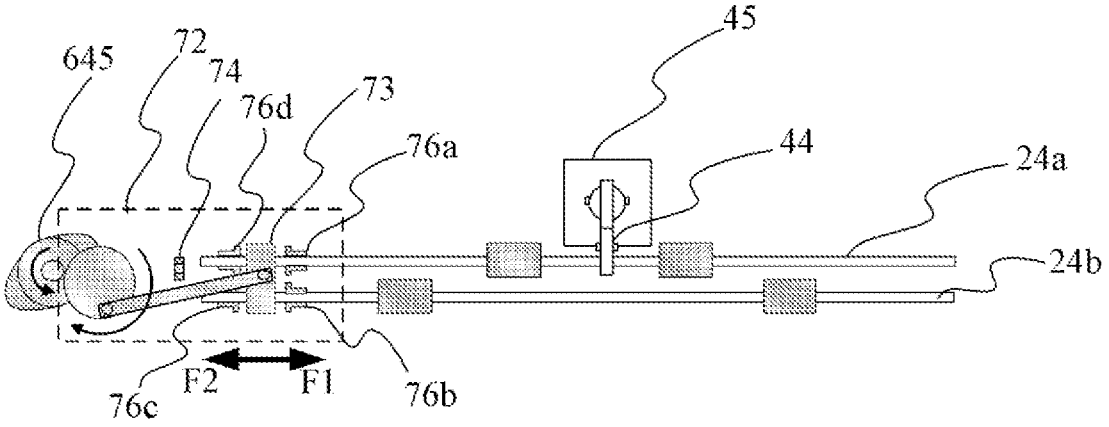
FIGS. 4A and 4B are outline views of a shift portion according to the present invention.
Figure 4B:
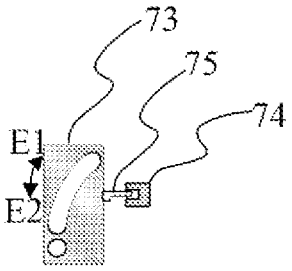

Next, the buffer portion and shift means constituting a part of the buffer portion will be described using FIGS. 3, 4A, 4B, and 5A to 5J. FIG. 3 is a cross-sectional view of the buffer portion, FIGS. 4A and 4B are outline views of the shift portion, and FIGS. 5A to 5J are operation views of the buffer portion.

The configuration of the buffer portion will be described using FIG. 3. A portion between the entrance roller 21 and the pre-buffer roller 22 is constituted by an entrance upper guide 40 and an entrance lower guide 41. A sheet is conveyed on a conveyance path constituted by both the conveyance guides. Further, an entrance sensor 27 is arranged at the entrance upper guide 40. The backflow prevention valve 23 is rotatably arranged by a rotation shaft 23*a* with respect to an inside sheet discharging upper guide 46 on the downstream side of the pre-buffer roller 22 and urged at all times in a C2 direction by a spring (not shown). The leading end of the backflow prevention valve 23 overlaps an inversion upper guide 42 in a comb-tooth shape. The backflow prevention valve 23 rotates in a C1 direction and causes the sheet to pass therethrough only when the sheet is fed by the pre-buffer roller 22. When the rear end of the sheet passes through the backflow prevention valve 23, the backflow prevention valve 23 rotates with the above-described spring (not shown) in the C2 direction and restores to its original position. Note that as conveyance paths, the entrance upper guide 40 and the entrance lower guide 41 form the first conveyance path 91, the inversion upper guide 42 and an inversion lower guide 43 form the switchback path 92 on which the conveyance direction of the sheet is switched according to a switchback, and the inside sheet discharging upper guide 46 and an inside sheet discharging lower guide 47 form a second conveyance path 93 on which the sheet is conveyed after the switchback.

The sheet discharging inversion roller 24 is constituted by an inversion upper roller 24*a* and an inversion lower roller 24*b*, and driving is supplied to both the rollers. Further, a separation lever 44 is connected to the inversion upper roller 24*a*. The separation lever 44 is rotatably supported by a lever support-point shaft 44*a* with respect to the inversion upper guide 42 and rotatably connected to a plunger solenoid 45 by a solenoid connection shaft 44*b*. When a current flows through the plunger solenoid 45, the separation lever 44 rotates in an E1 direction since the core of the plunger solenoid 45 moves in a D1 direction. As a result, the sheet discharging inversion roller 24 is put into a separated state. Further, when the current flowing through the plunger solenoid 45 stops, the inversion upper roller 24*a* moves in an E2 direction with a sheet discharging inversion roller pressing spring 48 and the plunger solenoid 45 moves in a D2 direction.

Next, the shift means will be described using FIGS. 4A and 4B. The shift means is configured to perform shift movement to move a sheet in a direction (width direction) orthogonal to the conveyance direction. The shift means is fixed to the sheet discharging inversion roller 24 as shown in FIG. 4A and transmits the rotational motion of a shift motor 645 to a slider 73 in a holding member 76 arranged to hold the slider 73 as linear motion using a shift crank mechanism 72. The holding member 76 includes holes (76*a*, 76*b*, 76*c*, and 76*d*) through which the inversion upper roller 24*a* and the inversion lower roller 24*b* are allowed to penetrate. With a configuration in which the inversion upper roller 24*a* and the inversion lower roller 24*b* penetrate the through-holes, it is possible to shift the inversion upper roller 24*a* and the inversion lower roller 24*b* in F1 and F2 directions. Further, with the formation of a shaft hole penetrating the slider 73 as shown in FIG. 4B, it is also possible to cause the inversion upper roller 24*a* to contact and separate from the inversion lower roller 24*b* while maintaining the rotation state of the sheet discharging inversion roller 24. The shift crank mechanism 72 has a shift-home position sensor 74 that detects the home position of a shift position and a light-shielding flag 75 attached to the slider 73. Further, on the basis of the home position detected by the shift-home position sensor 74, the shift motor 645 is driven to control a shift amount.

The outline of shift and buffer operations will be described using FIGS. 5A to 5J and 6A to 6J. Conveyed sheets are shown as S1, S2, and S3 and conveyed in order of S1, S2, and S3.

Figure 5A:
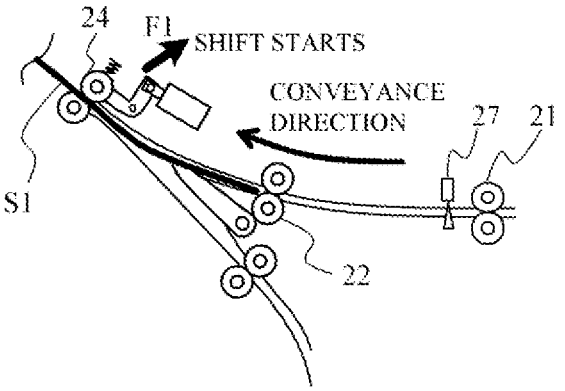
FIGS. 5A to 5J are operation views of the buffer portion according to the present invention.
Figure 6A:
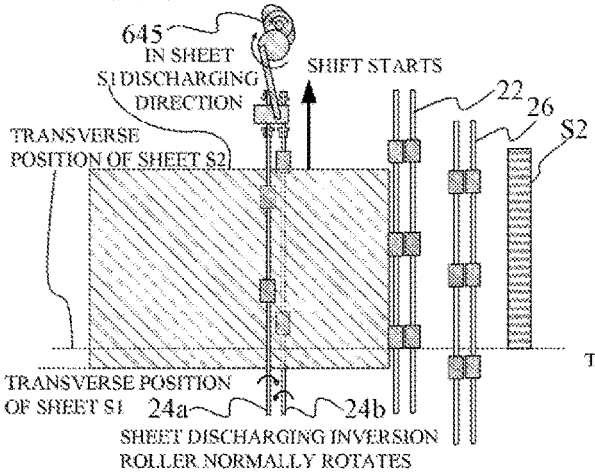
FIGS. 6A to 6J are overhead views of the operation of the buffer portion according to the present invention.

(1) The leading end of the sheet S1 passes through the switchback path 92 via the first conveyance path 91. Then, at a timing at which the rear end of the sheet S1 has passed through the pre-buffer roller 22, the shift motor 645 is driven to shift the sheet to a position at which the lateral end of the sheet S1 that is a preceding sheet (first sheet) aligns with the lateral end of the sheet S2 that is a following sheet (second sheet) in the direction (width direction) orthogonal to the conveyance direction (FIGS. 5A and 6A).

Figure 5B:
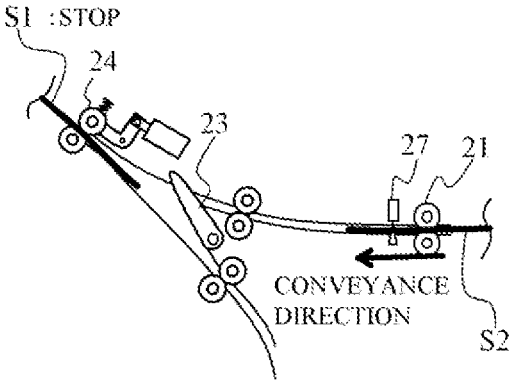
Figure 6B:
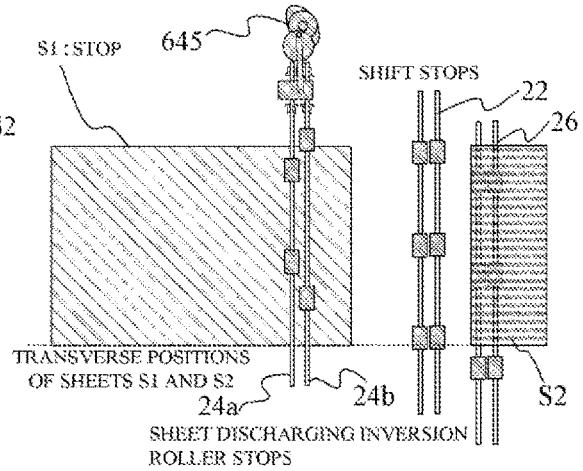

(2) The conveyance of the sheet S1 temporarily stops at a position at which the sheet S1 has passed through the backflow prevention valve 23 (FIGS. 5B and 6B).

Figure 5C:
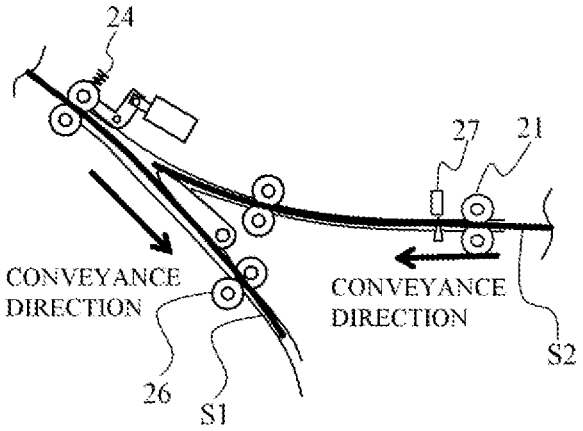
Figure 6C:
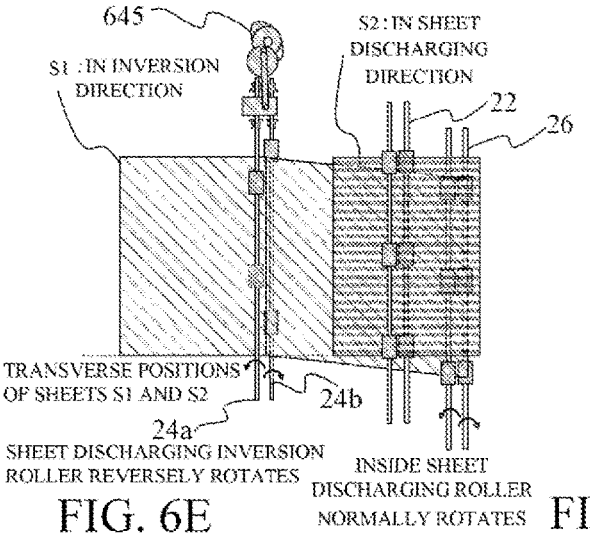

(3) The sheet S1 is caused to switchback by the sheet discharging inversion roller 24 of which the rotating direction is inverted and conveyed toward the inside sheet discharging roller 26. Note that the spot of the sheet S1 that served as the leading end in the conveyance direction is conveyed as the rear end of the sheet S1 in turn by the switchback. In the switchback, the conveyance direction of the sheet is switched, while the upper and lower surfaces of the conveyed sheet remain the same before and after the switchback (FIGS. 5C and 6C).

Figure 5D:
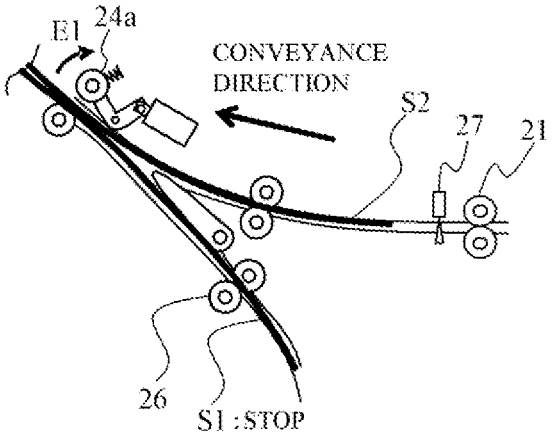
Figure 6D:
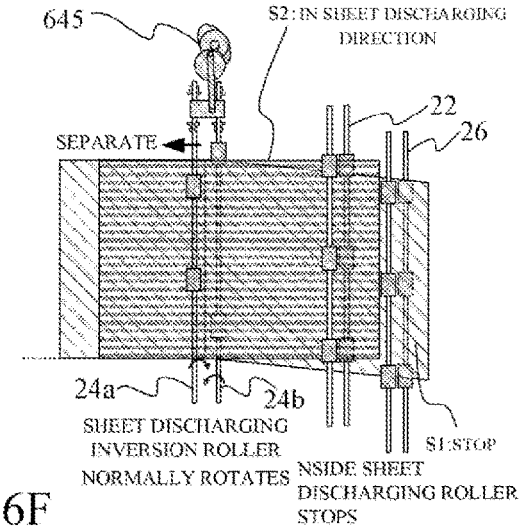

(4) The sheet S1 is held by the inside sheet discharging roller 26 and stops at a position at which the sheet S1 is conveyed by a prescribed amount. Further, the inversion upper roller 24*a* separates at a timing at which the sheet S1 is held by the inside sheet discharging roller 26. Then, after the separation of the inversion upper roller 24*a*, the leading end of the following sheet S2 passes through the switchback path 92 via the first conveyance path 91 and passes through the sheet discharging inversion roller 24. Further, after the separation of the inversion upper roller 24*a*, the sheet discharging inversion roller 24 changes its rotating direction (FIGS. 5D and 6D).

Figure 5E:
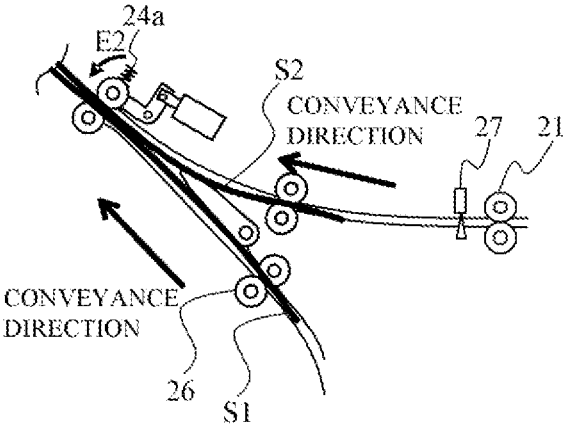
Figure 6E:
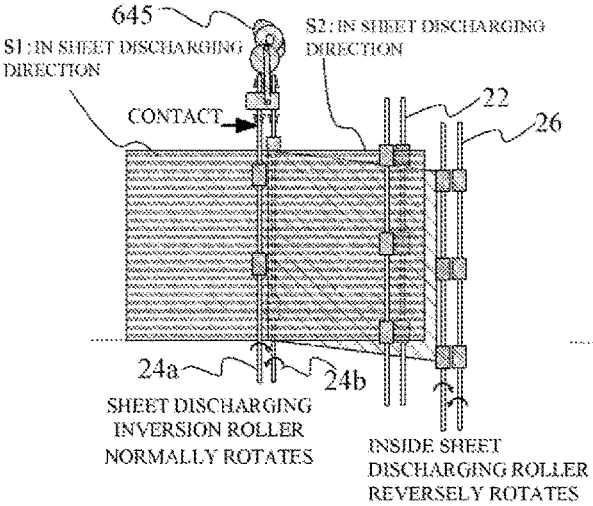

(5) At a timing at which the rear end of the following sheet S2 is conveyed by a prescribed amount after passing through the entrance sensor 27, the conveyance of the sheet S1 held by the inside sheet discharging roller 26 starts again toward the sheet discharging inversion roller 24. Then, at a timing at which the relative speed of the preceding sheet S1 conveyed toward the sheet discharging inversion roller 24 becomes approximately equal to that of the following sheet S2 conveyed toward the sheet discharging inversion roller 24, the inversion upper roller 24*a* contacts a sheet bundle and holds the sheets S1 and S2 at the same time with their transverse positions aligned (FIGS. 5E and 6E).

Figure 5F:
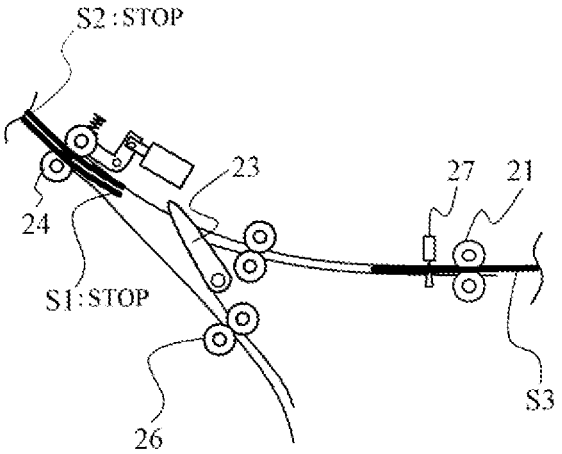
Figure 6F:
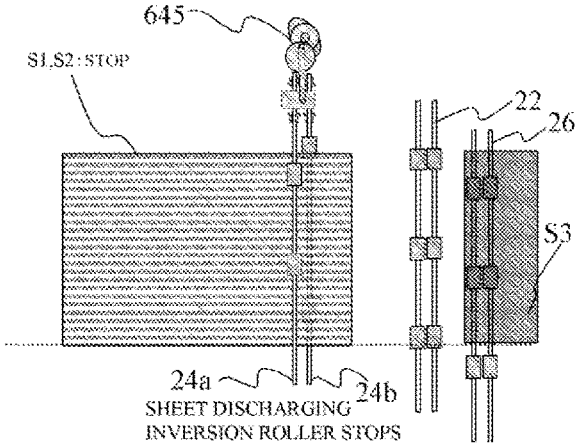

(6) The sheet bundle of the sheets S1 and S2 held by the sheet discharging inversion roller 24 is integrally conveyed in the downstream direction of the first conveyance path 91 (the upstream direction of the second conveyance path 93). Note that the sheet S2 before the switchback has its leading end in the downstream direction of the first conveyance path 91 and the sheet S1 after the switchback has its leading end in the downstream direction of the second conveyance path 93 (the sheet S1 has its rear end in the upstream direction of the second conveyance path 93) at this time. The integrated sheet bundle of the sheets S1 and S2 is conveyed as described above. After the respective rear ends of the sheets S1 and S2 pass through the backflow prevention valve 23, the sheet discharging inversion roller 24 stops, and the sheet bundle is conveyed to a position at which the sheet bundle falls within the switchback path 92. At this time, the position of the leading end of the following sheet S2 is arranged so as to overlap the position of the rear end of the preceding sheet S1 (FIGS. 5F and 6F).

Figure 5G:
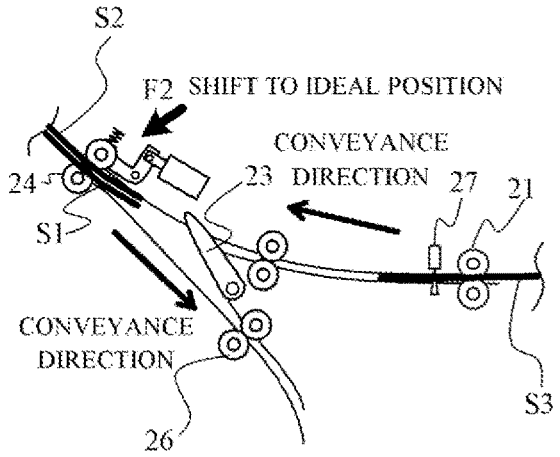
Figure 6G:
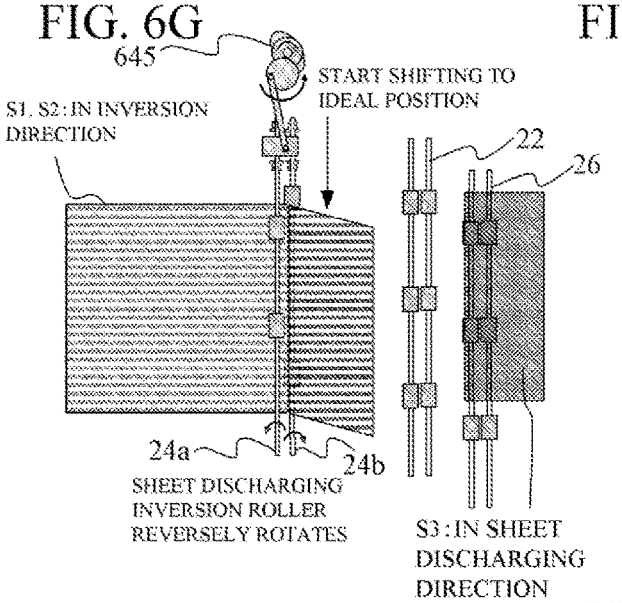

(7) The shift position of the sheet bundle of the sheets S1 and S2 held by the sheet discharging inversion roller 24 is set at an ideal position. Note that the ideal position represents a prescribed shift position other than a home position when it is assumed that a position at which a following sheet is conveyed is the home position. The shift of the sheet bundle is started as described above to move the sheet bundle in the direction orthogonal to the conveyance direction. Then, the sheet bundle is caused to switchback toward the inside sheet discharging roller 26 and conveyed in the direction of the second conveyance path 93 (FIGS. 5G and 6G).

Figure 5H:
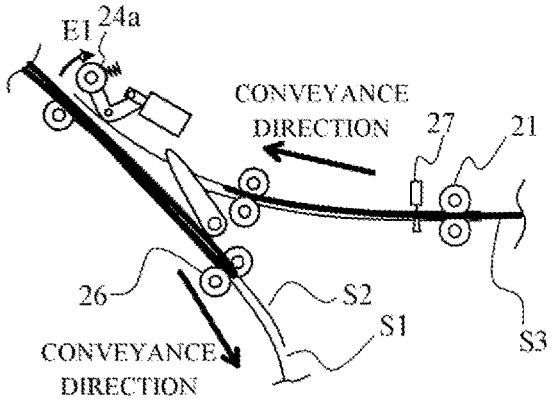
Figure 6H:
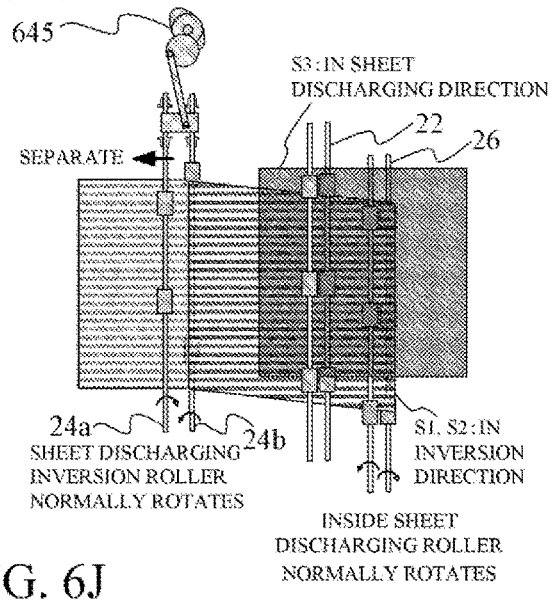

(8) At a timing at which the leading end of the sheet bundle of the sheets S1 and S2 is held by the inside sheet discharging roller 26, the inversion upper roller 24*a* is separated to prepare for the reception of a following sheet S3 (FIGS. 5H and 6H).

Figure 5I:
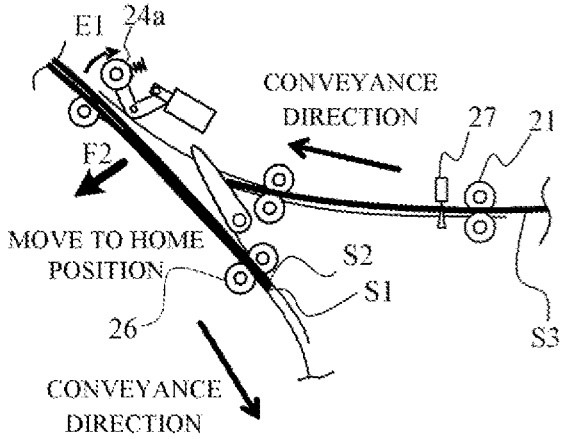
Figure 6I:
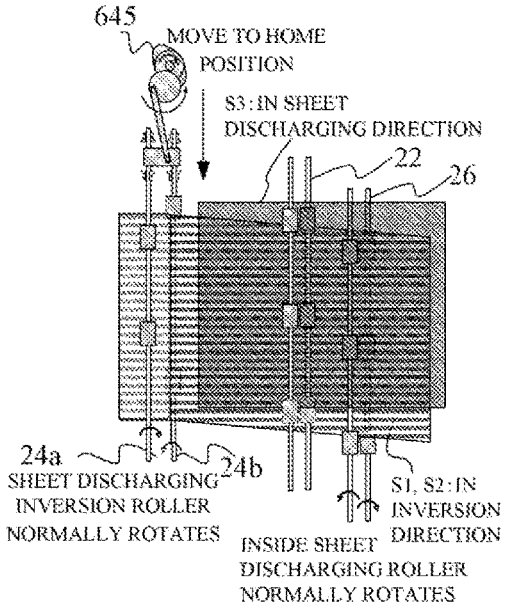

(9) After the separation of the inversion upper roller 24*a*, a shift mechanism is moved to the home position (FIGS. 5I and 6I).

Figure 5J:
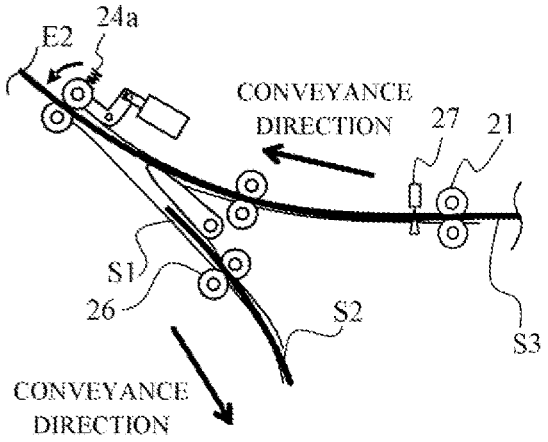
Figure 6J:
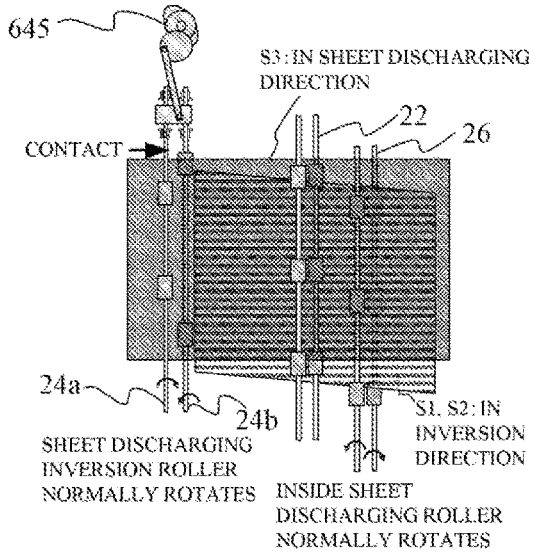

(10) At a timing at which the rear end of the sheet bundle of the sheets S1 and S2 conveyed in the direction of the second conveyance path 93 passes through the sheet discharging inversion roller 24, the sheet discharging inversion upper roller 24*a* is caused to contact the sheet S3 entering the switchback path 92 from the first conveyance path 91 and hold and convey the same. Note that the sheet S3 is a following sheet (second sheet) while the sheet S2 is a preceding sheet (first sheet) in this process (FIGS. 5J and 6J).

With the repetition of the above operations, it is possible to continuously carry out a buffer operation. Further, in the conveyance direction of the buffer portion, sheets overlap each other in a state in which the distance of a deviation between the rear end of a preceding sheet S1 and the leading end of a following sheet S2 that are caused to switchback falls within a certain range. It is possible to form a sheet bundle in which the position of the leading end of the following sheet S2 overlaps the position of the rear end of the preceding sheet S1 by making the sheets overlap each other as described above. It is also possible to realize the shift and the buffer of at least three sheets by the repetition of the operations (1) to (5). Note that the direction in which the sheets are shifted is shown as F1 and the movement to the home position is shown as F2 in FIGS. 5A to 5J but are not limited to the above example.

Figure 7:
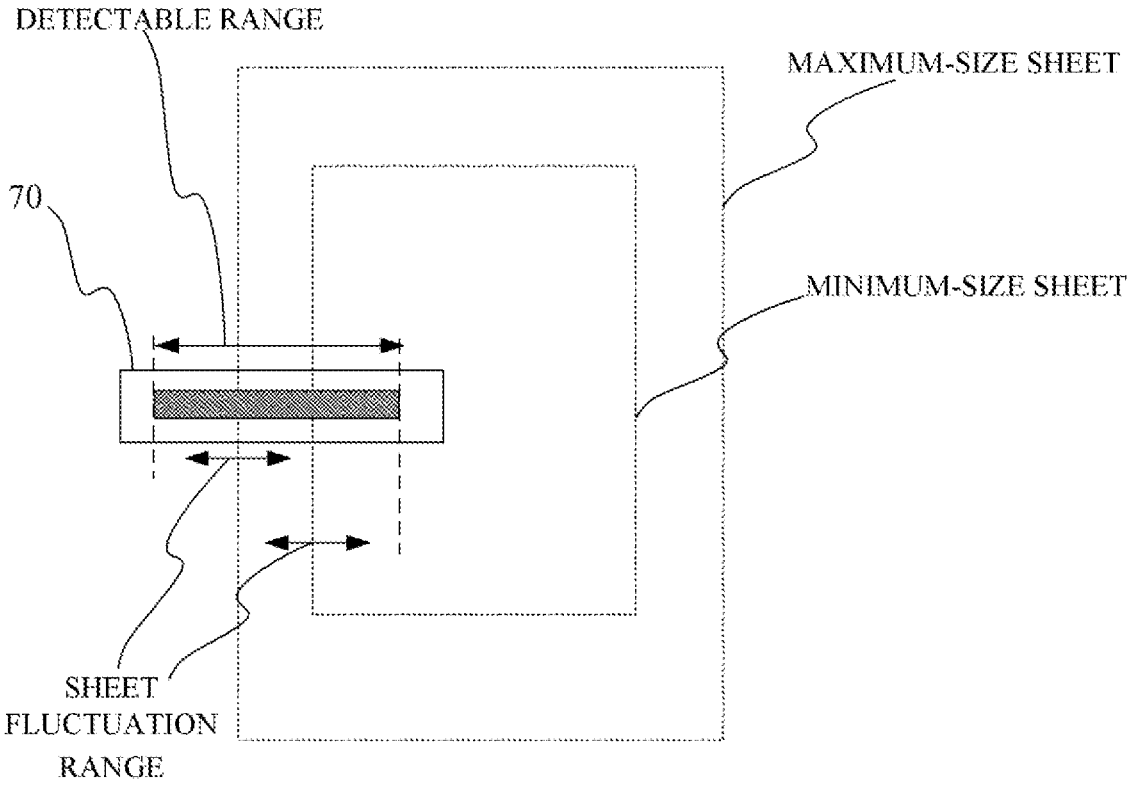
FIG. 7 is a view of a transverse position detection sensor according to the present invention.

Next, transverse position detection means according to the present embodiment will be described using FIGS. 1 and 7. In the present embodiment, a transverse position detection sensor 70 is provided as the transverse position detection means. As shown in FIG. 7, the transverse position detection sensor 70 is arranged to be capable of detecting all the transverse positions of the sheets of a maximum-size sheet to a minimum-size sheet in the conveyance direction. In the present embodiment, a line sensor is used as the detection portion of the transverse position detection sensor and determines a sheet transverse position with a boundary that detects the presence or absence of a sheet on the line sensor. Further, since the position of the line sensor is fixed inside the sheet post-processing apparatus 4, the line sensor calculates the position of a sheet conveyed inside the sheet post-processing apparatus 4 from the position of a pixel that has detected a sheet transverse position on the line sensor. The sheet post-processing apparatus 4 detects the transverse position of a sheet with the transverse position detection sensor 70 when a prescribed time elapses after the leading end of the sheet has passed through the entrance sensor 27.

Figure 8:
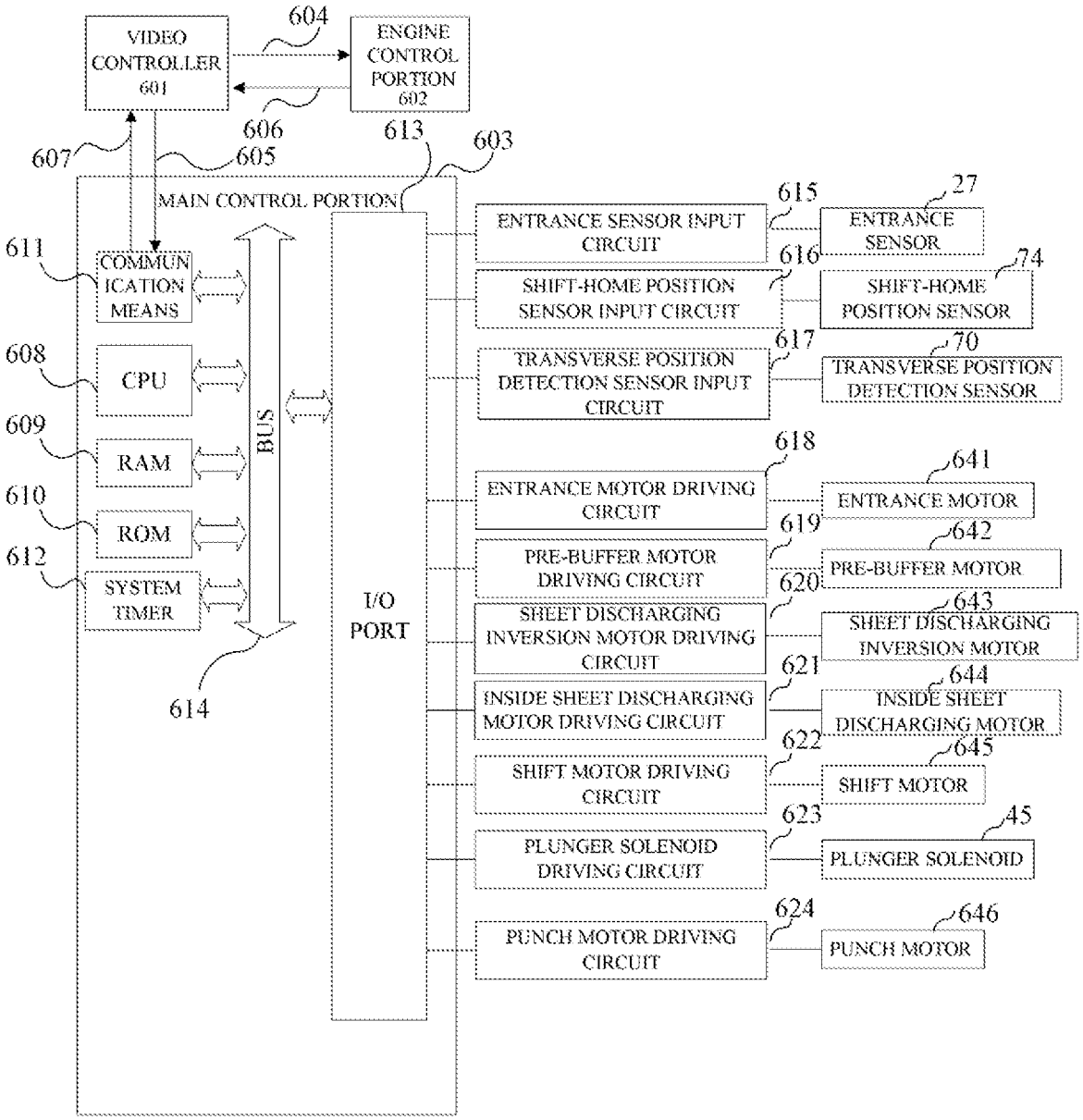
FIG. 8 is a hardware configuration diagram according to the present invention.

A hardware configuration according to the present embodiment will be described using FIG. 8. FIG. 8 is a diagram showing a hardware configuration in an image forming system in which the sheet post-processing apparatus 4 is attached to the image forming apparatus 1 shown in FIG. 1, mainly the configuration of the sheet post-processing apparatus 4 relating to the control of the present embodiment. Symbol 601 shows a video controller that exercises control over the image forming apparatus 1 and the sheet post-processing apparatus 4. Symbol 602 shows an engine control portion that controls the image forming apparatus 1. Symbol 603 shows a main control portion that controls the sheet post-processing apparatus 4. Symbol 604 shows a serial command transmission signal line that transmits a command from the video controller 601 to the engine control portion 602 through serial communication. Symbols 605 shows a serial command transmission signal line that transmits a command from the video controller 601 to the main control portion 603 through serial communication. Symbol 606 shows a serial status transmission signal line that transmits status data from the engine control portion 602 to the video controller 601 instead of a command through serial communication. Symbol 607 shows a serial status transmission signal line that transmits status data from the main control portion 603 to the video controller 601 instead of a command through serial communication. In performing an image forming operation, the video controller 601 transmits a serial command to the engine control portion 602 and the main control portion 603 while receiving status data from the engine control portion 602 and the main control portion 603 to perform control. When a plurality of apparatuses are connected and operated as described above, the video controller 601 manages the control or the states of the respective apparatuses and maintains operation consistency between the respective apparatuses.

The main control portion 603 is a control IC configured so that a CPU 608 or the like that will be described later is connected to an I/O port 613 with which control signals are input to and output from various units inside the sheet post-processing apparatus 4 through a bus 614. Note that portions connected to the I/O port 613 through the bus 614 are the CPU 608 that controls the various operations of the sheet post-processing apparatus 4, a RAM 609 that temporarily stores control data, a ROM 610 that stores a control table necessary for a program or an operation in a non-volatile manner, communication means 611 for performing communication processing with the video controller 601, and a system timer 612 that generates a timing necessary for various control. An entrance sensor input circuit 615 receives a signal from an entrance sensor 27 and transmits the received signal to the main control portion 603. A shift-home position sensor input circuit 616 receives a signal from a shift-home position sensor 74 and transmits the received signal to the main control portion 603. A transverse position detection sensor input circuit 617 receives a signal from a transverse position detection sensor 70 and transmits the received signal to the main control portion 603. Then, each of an entrance motor driving circuit 618, a pre-buffer motor driving circuit 619, a sheet discharging inversion motor driving circuit 620, an inside sheet discharging motor driving circuit 621, a shift motor driving circuit 622, a plunger solenoid driving circuit 623, and a punch motor driving circuit 624 receives a control signal from the main control portion 603. After receiving the control signal, each of the entrance motor 641, the pre-buffer motor 642, the sheet discharging inversion motor 643, the inside sheet discharging motor 644, the shift motor 645, the plunger solenoid 45, and the punch motor 646 drives.

Figure 9:
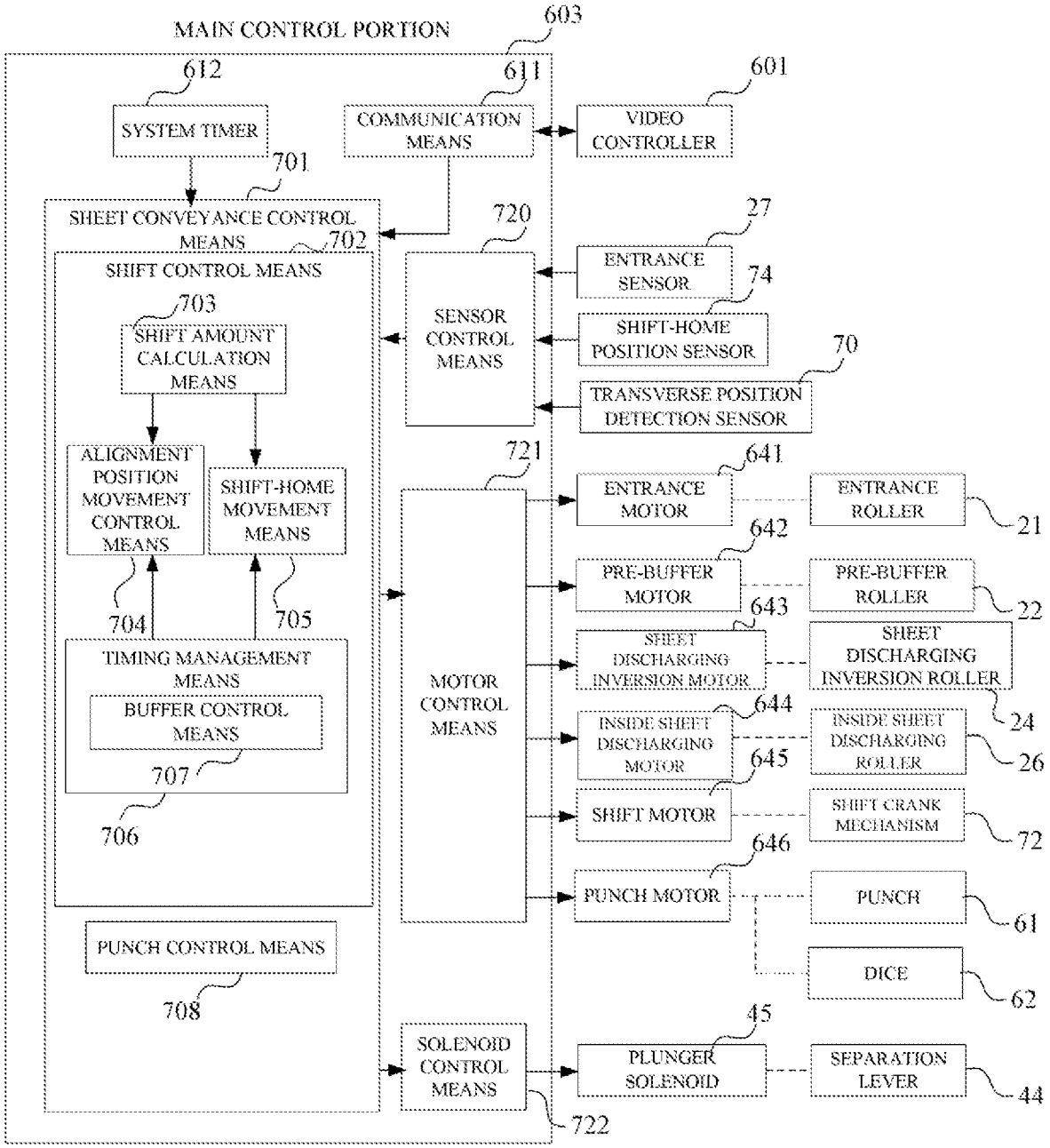
FIG. 9 is a control block diagram according to the present invention.

Function blocks according to the present embodiment will be described using FIG. 9. Here, only portions relating to the present embodiment will be extracted and described. In FIG. 9, symbol 603 shows the function of the main control portion of the sheet post-processing apparatus 4 that performs sheet conveyance control. The main control portion 603 is constituted by the communication means 611, the system timer 612, sheet conveyance control means 701, shift control means 702, sensor control means 720, motor control means 721, solenoid control means 722, buffer control means 707, and punch control means 708. The sensor control means 720 is means for inputting signals from the entrance sensor 27, the shift-home position sensor 74, and the transverse position detection sensor 70 to the sheet conveyance control means 701. The sheet conveyance control means 701 controls the shift control means 702, the buffer control means 707, the motor control means 721, the solenoid control means 722, and the punch control means 708 on the basis of instructions from the sensor control means 720. By these control means, the entrance motor 641, the pre-buffer motor 642, the sheet discharging inversion motor 643, the inside sheet discharging motor 644, the shift motor 645, the plunger solenoid 45, and the punch motor 646 are driven. Note that the driving target of the entrance motor 641 is the entrance roller 21, the driving target of the pre-buffer motor 642 is the pre-buffer roller 22, the driving target of the sheet discharging inversion motor 643 is the sheet discharging inversion roller 24, and the driving target of the inside sheet discharging motor 644 is the inside sheet discharging roller 26. Further, the driving target of the shift motor 645 is the shift crank mechanism 72, and the driving target of the plunger solenoid 45 is the separation lever 44. The driving targets of the punch motor 646 are the punch 61 and the dice 62.

The shift control means 702 is constituted by shift amount calculation means 703, timing management means 706, alignment position movement control means 704, and shift-home movement means 705. The shift amount calculation means 703 calculates a buffer shift amount for aligning and buffering a sheet on the basis of a plurality of information. The plurality of information includes sheet width information instructed from the video controller 601, environment information such as temperature and humidity, sheet buffer information, and information on the transverse position of a sheet received from the sensor control means 720. Further, the shift amount calculation means 703 is means for, when inverting and conveying a plurality of buffered sheets, calculating inversion shift amounts to align the transverse positions of the plurality of sheets with each other at a prescribed position, notifying the alignment position movement control means 704 of these shift amounts, and indicating the rotating direction of a motor to the shift-home movement means 705. The timing management means 706 is means for notifying the shift-home movement means 705 of a timing at which the movement of the shift means to a home is needed. The timing management means 706 notifies the alignment position movement control means 704 of a timing at which the shift control is performed on the basis of the signal information of the entrance sensor 27 received from the sensor control means 720. Further, the timing management means 706 includes the buffer control means 707 and performs motor control or solenoid control for the buffer control of a plurality of sheets with the buffer control means 707. The alignment position movement control means 704 is means for calculating the driving amount of a motor from a shift amount when receiving the notification of a timing at which shift movement is needed and the shift amount, controlling the respective motors using the motor control means 721, and performing the shift of a necessary amount of sheets. The shift-home movement means 705 is means for moving the shift means to a home position when receiving the notification of a timing at which movement to the home is needed. The movement means controls the motor control means 721 and the solenoid control means 722 according to a rotating direction instructed from the shift amount calculation means 703 and performs the movement on the basis of the signal information of the shift-home position sensor 74 received from the sensor control means 720. In addition, the punch control means 708 is means for performing the control of the boring apparatus.

Figure 10A:
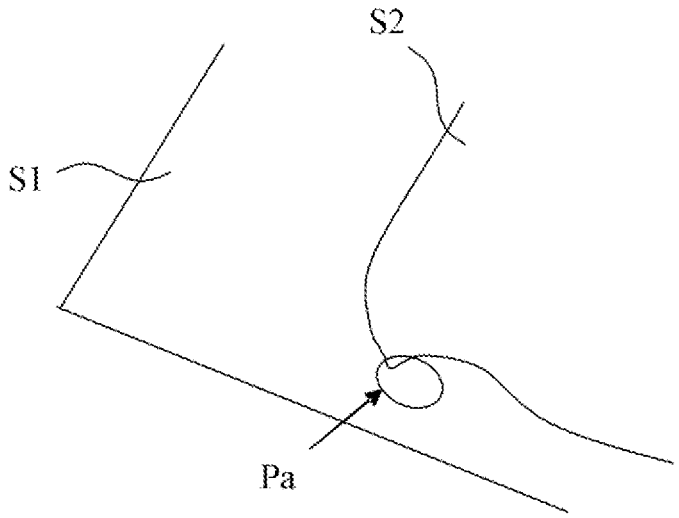
FIGS. 10A and 10B are views for describing a time at which a downwardly-curled sheet is conveyed to a sheet subjected to boring processing in the buffer portion.
Figure 10B:
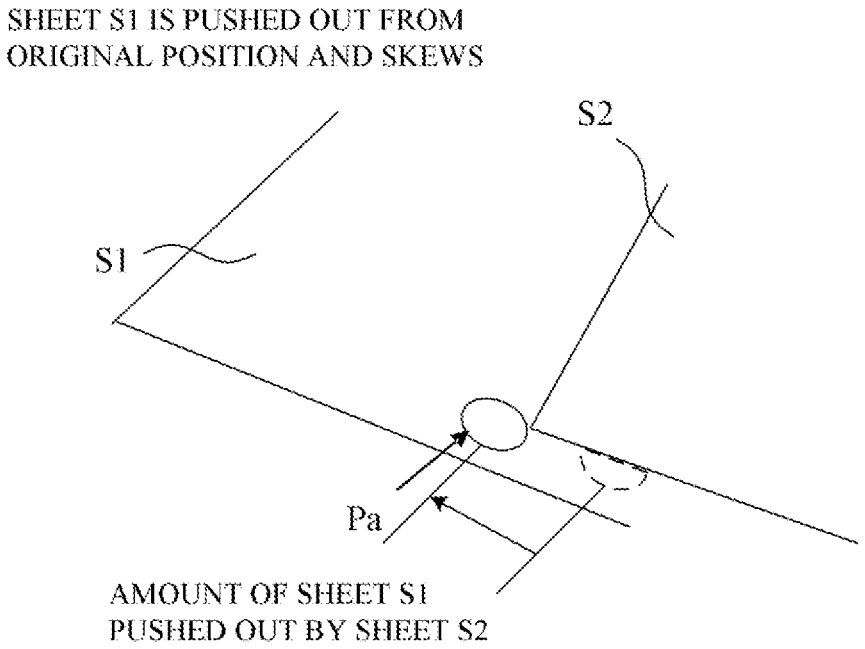

Here, when a boring hole Pa is formed on a preceding sheet S1 as shown in FIGS. 10A and 10B, there is a case that the leading end of a following sheet S2 contacts the boring hole Pa of the preceding sheet S1. FIG. 10A shows a time at which the downwardly-curled following sheet S2 contacts the boring hole of the sheet S1. FIG. 10B shows a state in which the leading end of the downwardly-curled sheet S2 jumps up with a repulsive force due to its stiffness and pushes out the sheet S1 to cause a skew. Note that the downwardly-curled sheet here represents a sheet curled in a protruding shape against the sheet S1. Alternatively, the downwardly-curled sheet may be expressed as a curved sheet with its left and right ends positioned below the center of the sheet in a vertical direction. One of reasons causing a curl in a sheet as described above is an amount of heat applied to the sheet by the fixing unit 11. When an amount of heat is applied from the fixing unit 11 to fix a toner image on a sheet, the sheet shrinks due to the evaporation of water contained in the sheet. At this time, there is a case that the amount of heat applied is different between the front surface and the rear surface of the sheet depending on the configuration of the fixing unit 11. In this case, a downward curl is caused in the sheet since there is a difference in a shrinkage degree between the front surface and the rear surface of the sheet. In addition, when humidity is high as a surrounding environment, a downward curl is easily caused since the moisture absorption of the sheet accelerates and water contained in the sheet increases.

Figure 11A:
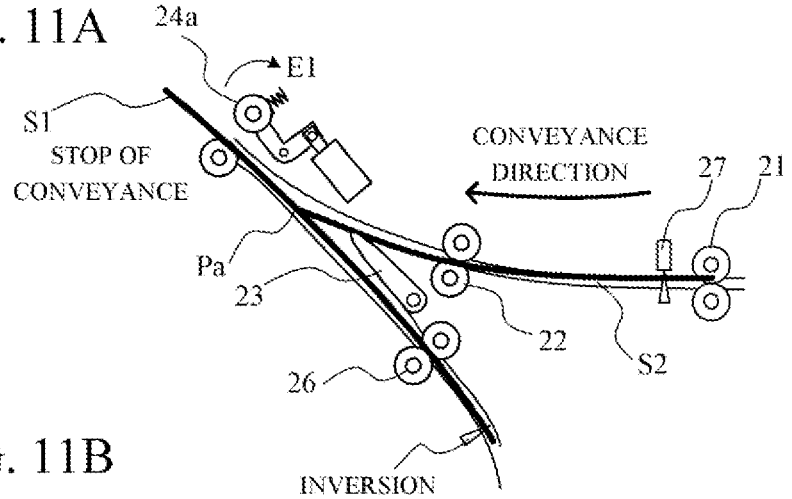
FIGS. 11A to 11C are views for describing the buffer operation of a sheet subjected to boring processing in a conventional buffer portion.
Figure 11B:
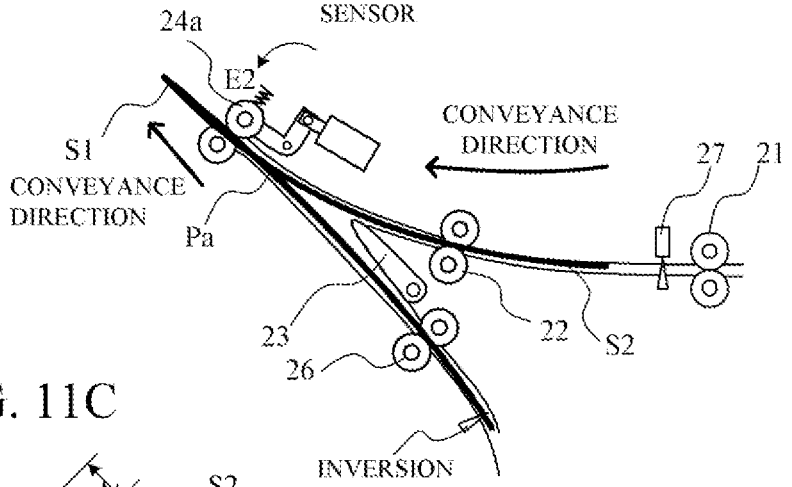
Figure 11C:
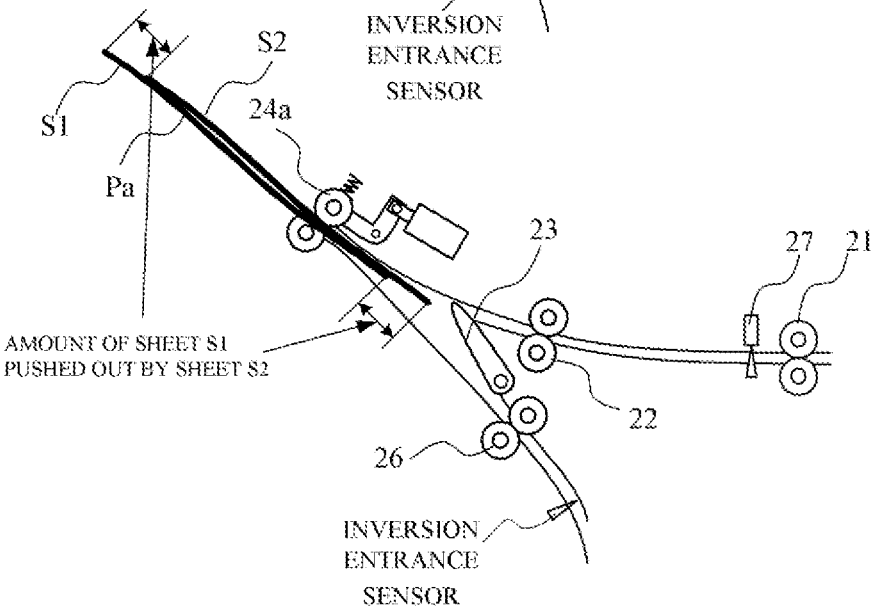

FIGS. 11A to 11C are views showing a state in which the buffer operation of a bored sheet S1 and a bored sheet S2 is performed and a state in which pushing out is caused during buffer processing. FIG. 11A shows a state in which the corner portion of the leading end of the following sheet S2 contacts a boring hole Pa of the sheet S1 in a state in which the sheet S1 is placed in the buffer portion. Next, FIG. 11B shows a state in which the corner portion of the leading end of the sheet S2 is held as a sheet bundle while contacting the boring hole Pa of the sheet S1. Further, FIG. 11C shows a state in which the sheet bundle of the bored sheet S1 and the bored sheet S2 is stopped to perform a switchback toward the inside sheet discharging roller 26 as described in FIG. 5F. At this time, the retention of the inversion upper roller 24*a* to hold the sheet bundle of the sheets S1 and S2 is not strong since the inversion upper roller 24*a* is urged by a spring. Accordingly, when the corner portion of the leading end of the sheet S2 contacting the boring hole Pa of the sheet S1 jumps up at a certain timing, there is a case that the sheet S1 is pushed out in the conveyance direction. If the pushing out of the sheet S1 is caused, the protruding amounts of the sheets S1 and S2 after the end of the buffer operation are different from expected amounts.

After the sheet bundle is conveyed to the intermediate loading portion 71 inside the sheet post-processing apparatus 4, the half-moon roller 33 conveys the sheets of the sheet bundle to the longitudinal alignment reference plate 39 at a prescribed timing to align the ends of the sheets with each other in the conveyance direction of the sheet bundle. At this time, the half-moon roller 33 rotates while contacting the sheets in order from the sheet of the lowermost surface of the sheet bundle through its contact portion that is a part of the half-moon roller 33. Thus, a conveyance force is applied toward the longitudinal alignment reference plate 39 in order from the sheet of the lowermost surface of the sheet bundle, the sheets sequentially contact the longitudinal alignment reference plate 39, and the ends of the sheet bundle are aligned with each other. Note that as described in the mechanism of the buffer portion, the sheets of the sheet bundle overlap each other from below in order of their conveyance to form the sheet bundle. Therefore, if the overlap of the sheets of the sheet bundle is different from an expected one as in a case in which the preceding sheet is pushed out by the following sheet, there is a possibility that the leading ends of the sheets do not contact the longitudinal alignment reference plate 39 and the sheet bundle inside the intermediate loading portion 71 is not aligned. Accordingly, in order to solve a problem that protruding amounts during a buffer operation are different from expected amounts as described above, the following control is performed as the first embodiment to avoid the occurrence of pushing out caused by the boring hole of the preceding sheet and the corner portion of the leading end of the following sheet.

Figure 12A:
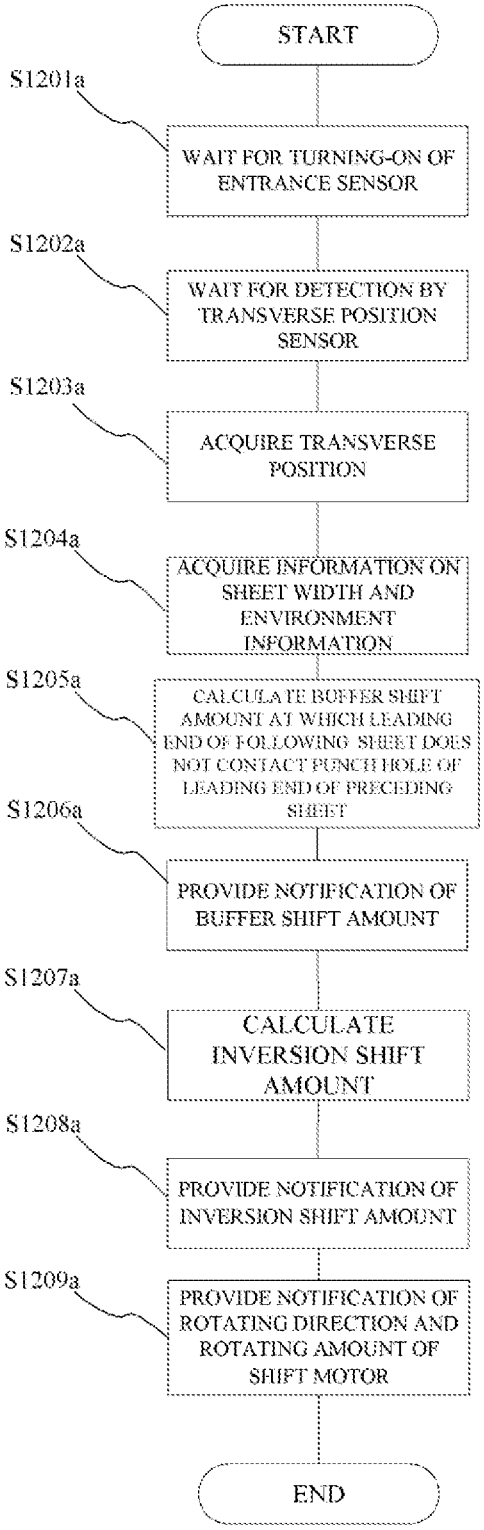
FIGS. 12A and 12B are flowcharts showing the operation of a sheet post-processing apparatus 4 according to the first embodiment.
Figure 12B:
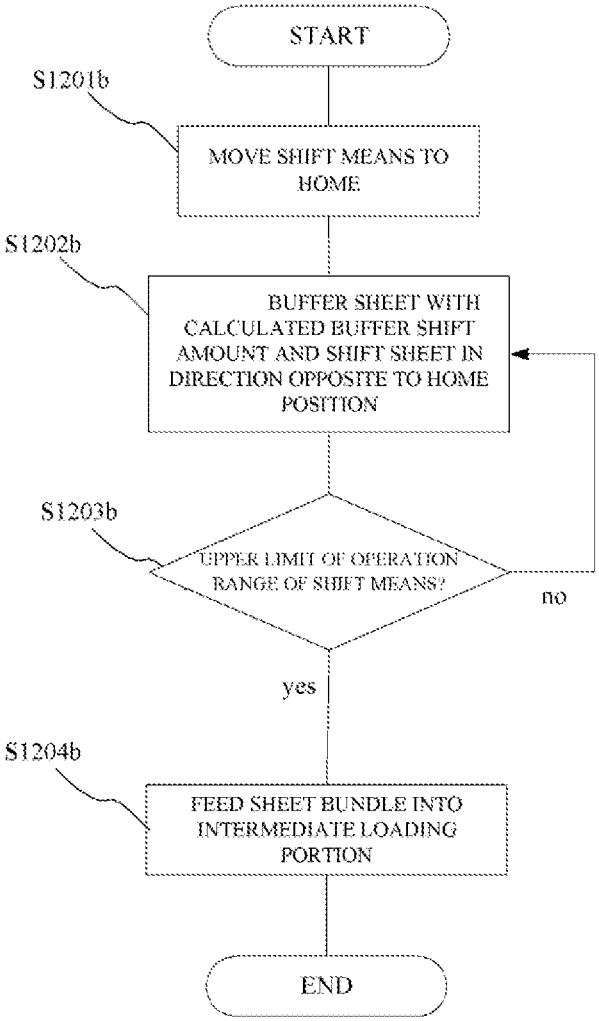

FIGS. 12A and 12B are flowcharts showing the operation of the sheet post-processing apparatus 4 according to the present embodiment. FIG. 12A is a control flowchart of the shift amount calculation means 703. The shift amount calculation means 703 activates at a timing at which a sheet width and environment information are notified from the video controller 601 and waits for the detection of the leading end of a sheet conveyed from the image forming apparatus 1 by the entrance sensor 27 (S1201*a*). Using a timing at which the leading end of the sheet has turned on the entrance sensor 27 as a starting point, the shift amount calculation means 703 waits for a timing until the transverse position of the sheet is detected by the transverse position detection sensor 70 (S1202*a*). The shift amount calculation means 703 acquires information on the transverse position of the detected sheet (S1203*a*) and information on the sheet width and the environment information instructed from the video controller 601 (S1204*a*). On the basis of these information, the shift amount calculation means 703 calculates a buffer shift amount to move the preceding sheet to a position at which the leading end of a following sheet does not contact a boring hole of the preceding sheet (S1205*a*). Then, the shift amount calculation means 703 notifies the alignment position movement control means 704 of the buffer shift amount (S1206*a*). Similarly, the shift amount calculation means 703 calculates an inversion shift amount (S1207*a*) and notifies the alignment position movement control means 704 of the inversion shift amount (51208*a*). Finally, the shift amount calculation means 703 notifies the shift-home movement means 705 of the rotating amount of the shift motor 645 to return to a home position (51209*a*) and ends the processing.

FIG. 12B is a control flowchart of the sheet conveyance control means 701. Since the sheet conveyance control means 701 includes the shift control means 702 and the buffer control means 707, the present control flow is represented as including the control flow of the shift control means 702 and the buffer control means 707. The shift control means 702 moves the shift means to the home position (S1201*b*) and performs buffer processing on the sheet conveyed with the calculated buffer shift amount. Then, it is shifted in the opposite direction to the home position (S1202*b*). When the position of the shifted sheet reaches the upper limit of the operation range of the shift means (Yes in S1203*b*), the sheet conveyance control means 701 feeds the sheet bundle into the intermediate loading portion 71 (S1204*b*) and ends a series of the processing. When the position of the shifted sheet does not reach the upper limit of the operation range of the shift means (No in S1203*b*), the sheet conveyance control means 701 receives a following sheet without moving the position of the shift means and performs buffer processing and shift processing with the calculated buffer shift amount.

Figure 13A:
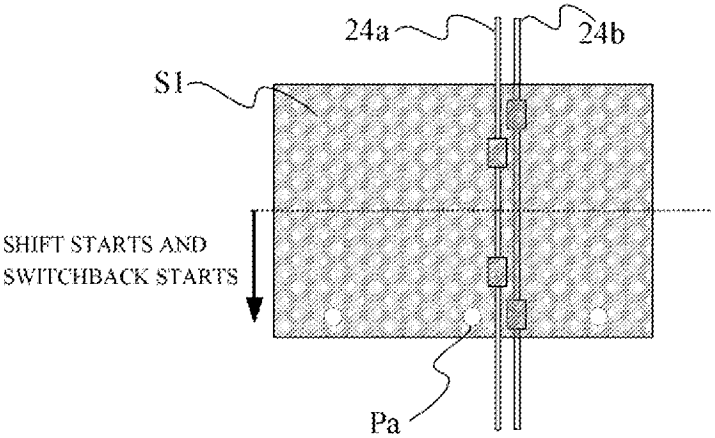
FIGS. 13A to 13D are upper surface views showing the state of a sheet bundle subjected to buffer processing according the first embodiment.
Figure 13B:
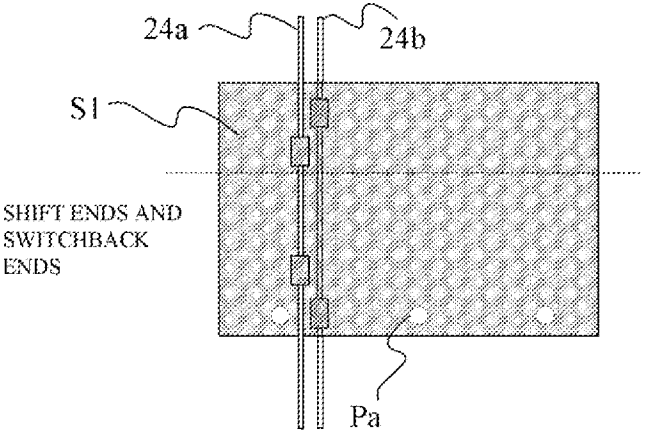
Figure 13C:
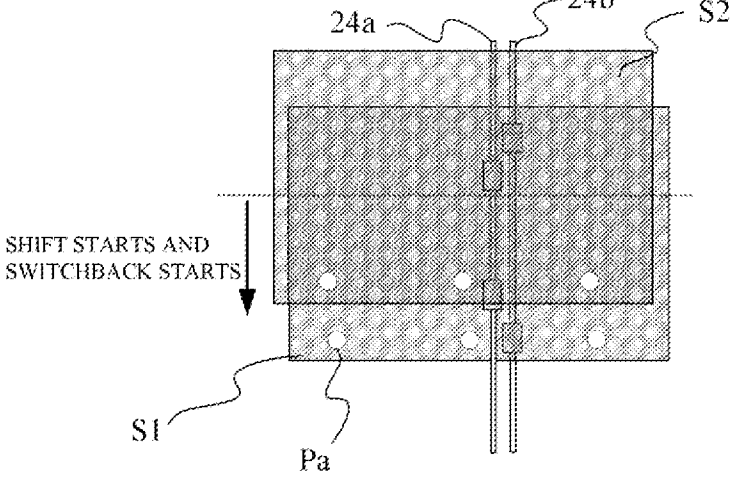
Figure 13D:
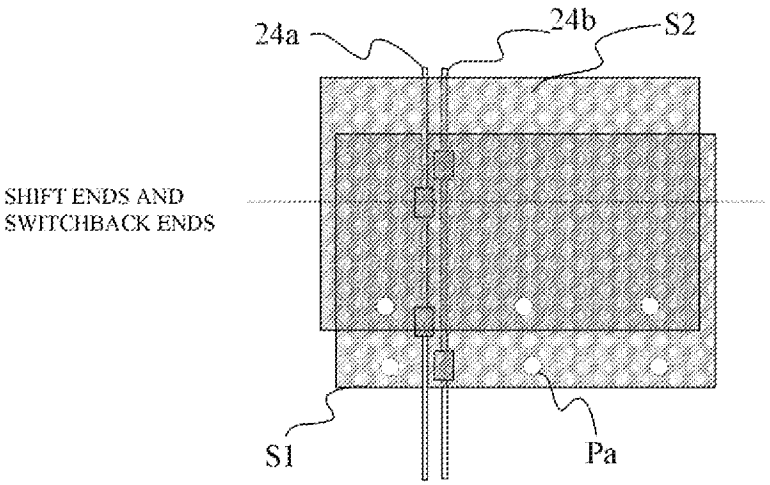

FIGS. 13A to 13D are views showing the state of a sheet bundle in the buffer portion of the sheet post-processing apparatus 4 in a case in which the operation processing of FIGS. 12A and 12B is performed. After moving the shift means to the home position, the buffer portion receives a bored sheet S1 over the first conveyance path 91 and the switchback path 92 (FIG. 13A). Next, the buffer portion performs buffer processing and shift processing with the sheet discharging inversion roller 24. As a result, the sheet S1 is arranged at a shift position at which the sheet S1 has moved in a direction orthogonal to the conveyance direction, and put over the switchback path 92 and the second conveyance path 93 (FIG. 13B). Then, a subsequent curled sheet S2 is conveyed to the buffer portion, and the buffer portion receives the sheet S2 over the first conveyance path 91 and the switchback path 92. At this time, the buffer portion receives the sheet S2 with the position of the shift means unchanged (FIG. 13C). As described above, the following sheet S2 is conveyed to the home position while the conveyed preceding sheet S1 is shifted. Therefore, it is possible to overlap the sheets with each other in a state in which the respective relative positions of the preceding sheet S1 and the following sheet S2 are deviated in a width direction. After that, the buffer portion performs buffer processing and shift processing with the sheet discharging inversion roller 24, and the sheet S2 is arranged at the shift position and put over the switchback path 92 and the second conveyance path 93 (FIG. 13D). By performing the buffer processing and the shift processing in combination as described above, it is possible to form a sheet bundle while preventing the leading end of the sheet S2 from contacting the boring hole of the sheet S1. Note that a sheet bundle in which the leading end of the following sheet S2 overlaps the rear end of the preceding sheet S1 caused to switchback in the conveyance direction is formed during buffer processing in the present embodiment as well.

As described above, it is possible to form a sheet bundle that is free from an unexpected and sudden deviation caused when the leading end of a sheet contacts a boring hole even when the sheet subjected to boring processing is conveyed to the buffer portion according to the present embodiment. The present embodiment shows an example of the buffer of two sheets. However, when sheets are overlapped with each other in the buffer processing of at least three sheets, the sheets may be overlapped with each other in a direction orthogonal to the conveyance direction in such a manner that the leading end of a following sheet avoids a boring hole over the rear end of a preceding sheet caused to switchback in the conveyance direction in the same direction. Sheet bundles are formed in a staircase pattern when the sheets are overlapped with each other in one direction as in the present embodiment.

Note that although the above embodiment assumes a case in which sheets forming a sheet bundle in the buffer portion have the same size and a downward curl is caused in a following sheet, the present invention is applicable so long as a relationship in which sheets forming a sheet bundle have different sizes but the leading end of a following sheet contacts a boring hole of a preceding sheet is established. Further, shift control to avoid a boring hole is applied to all papers in the present embodiment. However, the shift control to avoid a boring hole may be applied only to a sheet that is easily curled (such as a thin paper and a moisture absorption sheet) or a sheet in which a protruding curl is caused and may not be applied to a sheet that is not curled. Further, a setting like a curled sheet conveyance mode to change an operation when a curled sheet is conveyed may be provided in the image forming system or the sheet post-processing apparatus, and the shift control to avoid a boring hole may be employed only when the setting becomes valid.

Second Embodiment

Next, a second embodiment of the present invention will be described. In the present embodiment, a preceding sheet is not deviated in the same direction unlike the first embodiment but buffer processing and shift processing are alternately performed so as not to contact a boring hole. Since a hardware configuration and a control block diagram are the same as those of the first embodiment and the operation of a sheet post-processing apparatus 4 is also the same as that of the first embodiment in the present embodiment, their descriptions will be omitted.

Figure 14:
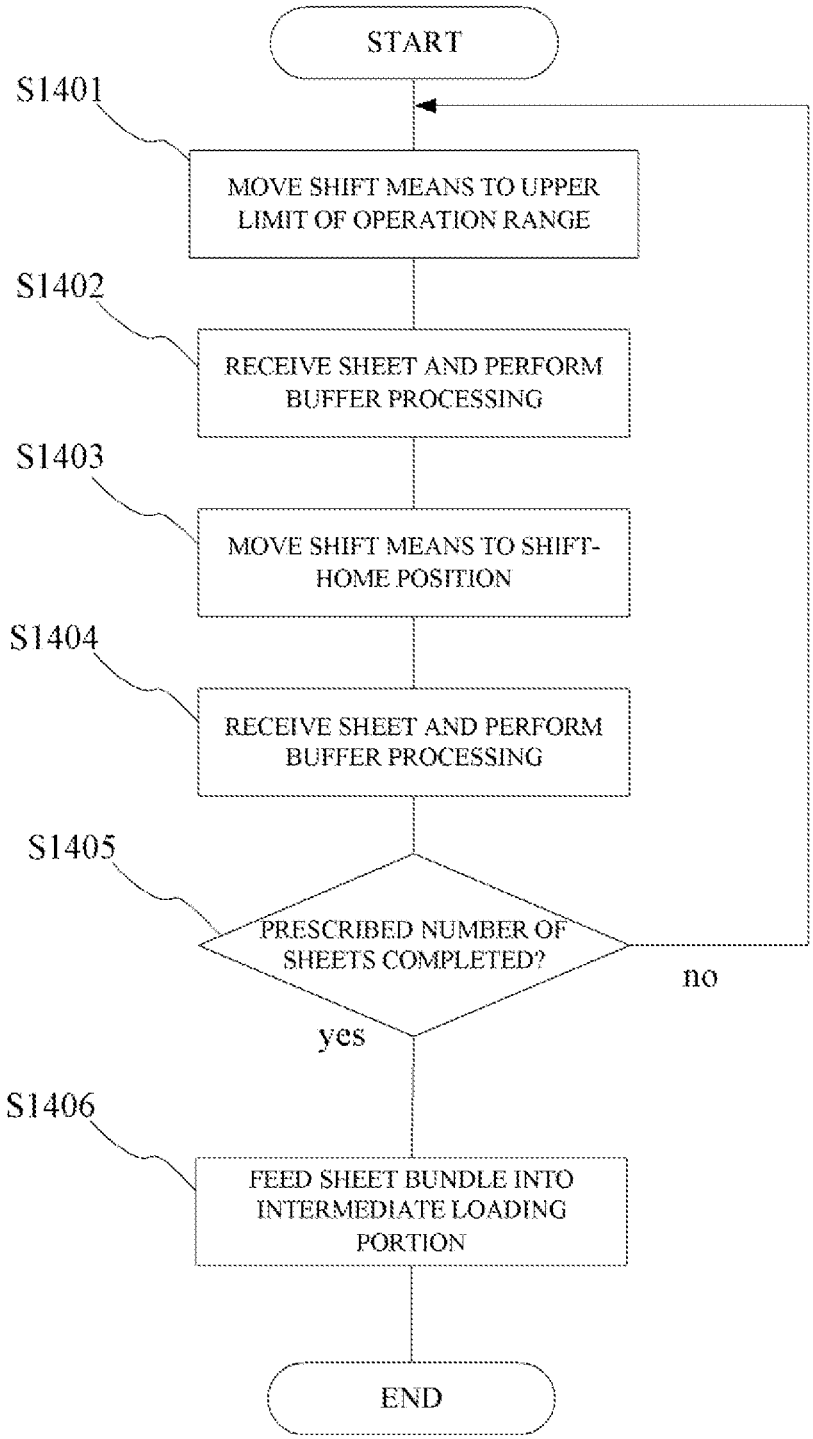
FIG. 14 is a flowchart showing the operation of a sheet post-processing apparatus 4 according to a second embodiment.

FIG. 14 is a control flowchart of the sheet post-processing apparatus 4 according to the present embodiment. Shift control means 702 moves shift means to the upper limit of an operation range (S1401). The shift control means 702 receives a sheet after completing the movement of the shift means and performs buffer processing (S1402). Next, the shift control means 702 moves the shift means to a shift-home position while receiving the sheet (S1403). The shift control means 702 receives a following sheet and performs buffer processing (S1404). Then, the shift control means 702 determines whether the buffer processing of a prescribed number of sheets has been completed. When the buffer processing has been completed (Yes in S1405), the shift control means 702 feeds a sheet bundle into an intermediate loading portion (S1406). When the buffer processing of the prescribed number of sheets has not been completed (No in S1405), the shift control means 702 performs the processing of S1401 to S1404 to generate a sheet bundle.

Figure 15A:
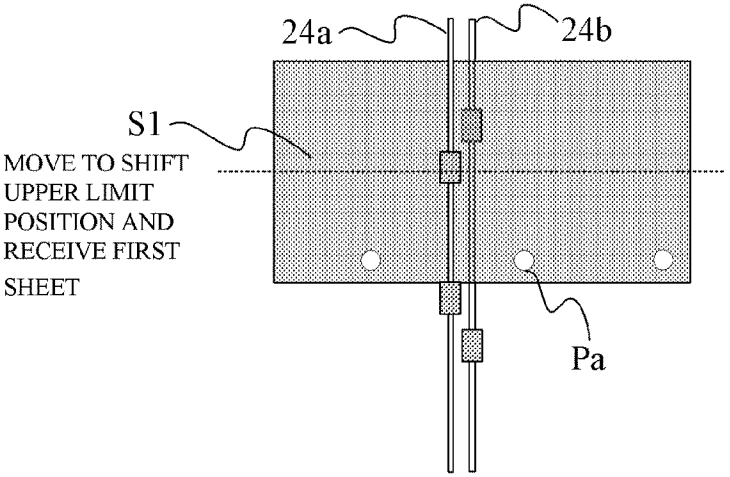
FIGS. 15A to 15D are upper surface views showing the state of a sheet bundle subjected to buffer processing according to the second embodiment.
Figure 15B:
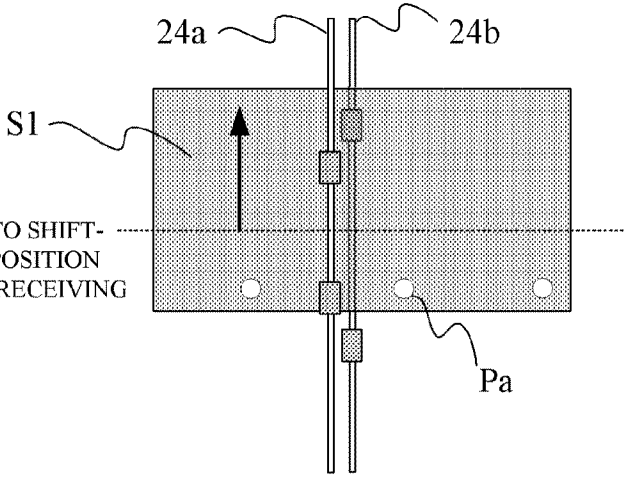
Figure 15C:
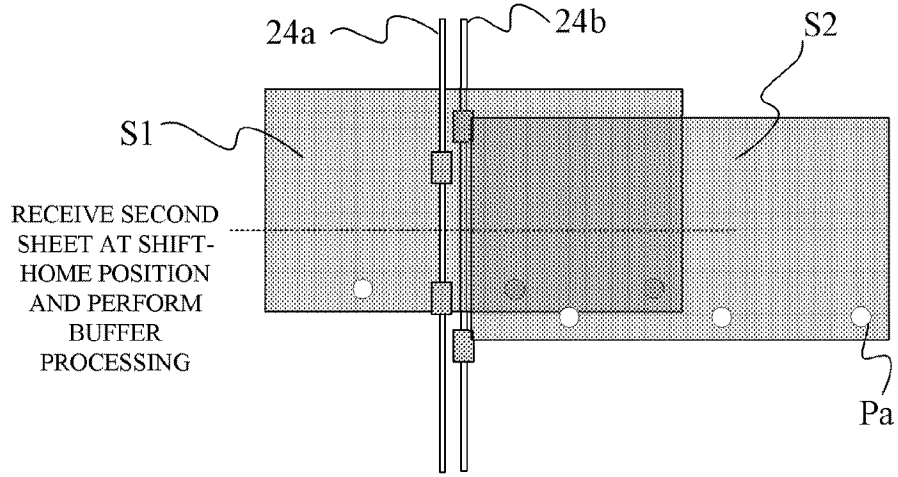
Figure 15D:
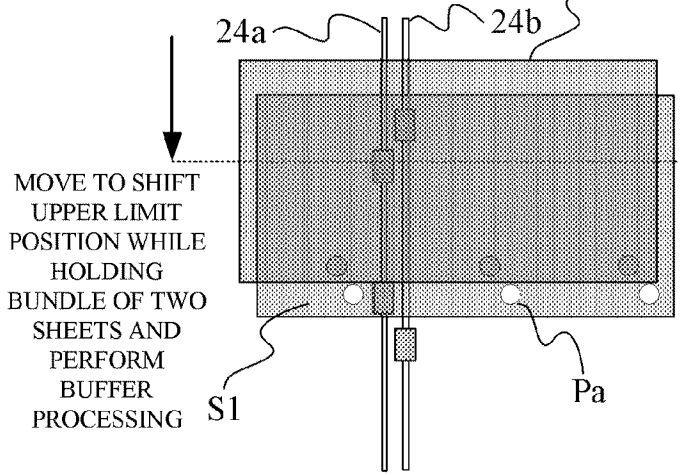

FIGS. 15A to 15D are views showing the state of a sheet bundle in the buffer portion of the sheet post-processing apparatus 4 in a case in which the operation processing of FIG. 14 is performed. After moving the shift means to the upper limit position of the operation range (moving the shift means to the lowermost position in FIG. 15A), the shift control means 702 receives a sheet S1 over a first conveyance path 91 and a switchback path 92 (FIG. 15A). Next, the shift control means 702 holds the sheet S1 with a sheet discharging inversion roller 24 and moves the shift means to the shift-home position (FIG. 15B). Then, when the shift control means 702 performs buffer processing, the sheet S1 is arranged over a switchback path 92 and a second conveyance path 93. Then, after receiving a following sheet S2 over the first conveyance path 91 and the switchback path 92, the shift control means 702 performs buffer processing to form a sheet bundle (FIG. 15C). Then, the shift control means 702 shifts the shift means to the upper limit position of the operation range (shifts the shift means to the lowermost position in FIG. 15D) and performs buffer processing (FIG. 15D). After completing the buffer processing of a prescribed number of sheets, the shift control means 702 feeds a sheet bundle into the intermediate loading portion. By performing buffer processing and shift processing in combination as described above, it is possible to form a sheet bundle while preventing the leading end of the following sheet S2 from contacting a boring hole of the preceding sheet S1. In the first embodiment, the sheets of a sheet bundle are overlapped with each other in the same direction. In the second embodiment, shift processing in one direction and shift processing in the other direction are alternately performed, whereby sheets are alternately overlapped with each other at the upper limit position of the shift operation range and the home position. Therefore, the present embodiment is characterized in that the formation of a sheet bundle having a constant width in a direction orthogonal to a conveyance direction is allowed. Note that a sheet bundle in which the leading end of the following sheet S2 overlaps the rear end of the preceding sheet S1 caused to switchback in the conveyance direction is formed during buffer processing in the present embodiment as well.

As described above, it is possible to form a sheet bundle that is free from an unexpected and sudden deviation while preventing the leading end of a sheet from contacting a boring hole even when the sheet subjected to boring processing is conveyed to the buffer portion according to the present embodiment. The present embodiment shows an example of the buffer of two sheets. However, when the buffer of at least three sheets is performed, the sheets may be alternately deviated from each other so as to avoid a boring hole. Further, the movement range of the shift means is set at the upper limit position of the operation range in the present embodiment. However, the present invention is applicable so long as the movement range is a prescribed amount with which it is possible to avoid a boring hole. The present invention is applicable so long as a relationship in which sheets forming a sheet bundle have different sizes but the leading end of a following sheet contacts the boring hole of a preceding sheet is established. In the present embodiment, shift control to avoid a boring hole is applied to all papers. However, the shift control to avoid a boring hole may be applied only to a sheet that is easily curled (such as a thin paper and a moisture absorption sheet) or a sheet in which a protruding curl is caused and may not be applied to a sheet that is not curled. Further, a setting like a curled sheet conveyance mode to change an operation when a curled sheet is conveyed may be provided in the image forming system or the sheet post-processing apparatus, and the shift control to avoid a boring hole may be employed only when the setting becomes valid.

Third Embodiment

In addition, a third embodiment of the present invention will be described. In the present embodiment, a sheet is not deviated in a direction orthogonal to a conveyance direction but a timing at which a preceding sheet and a following sheet are overlapped with each other is adjusted to perform buffer processing so as to prevent the leading end of a sheet from contacting a boring hole.

Figure 16:
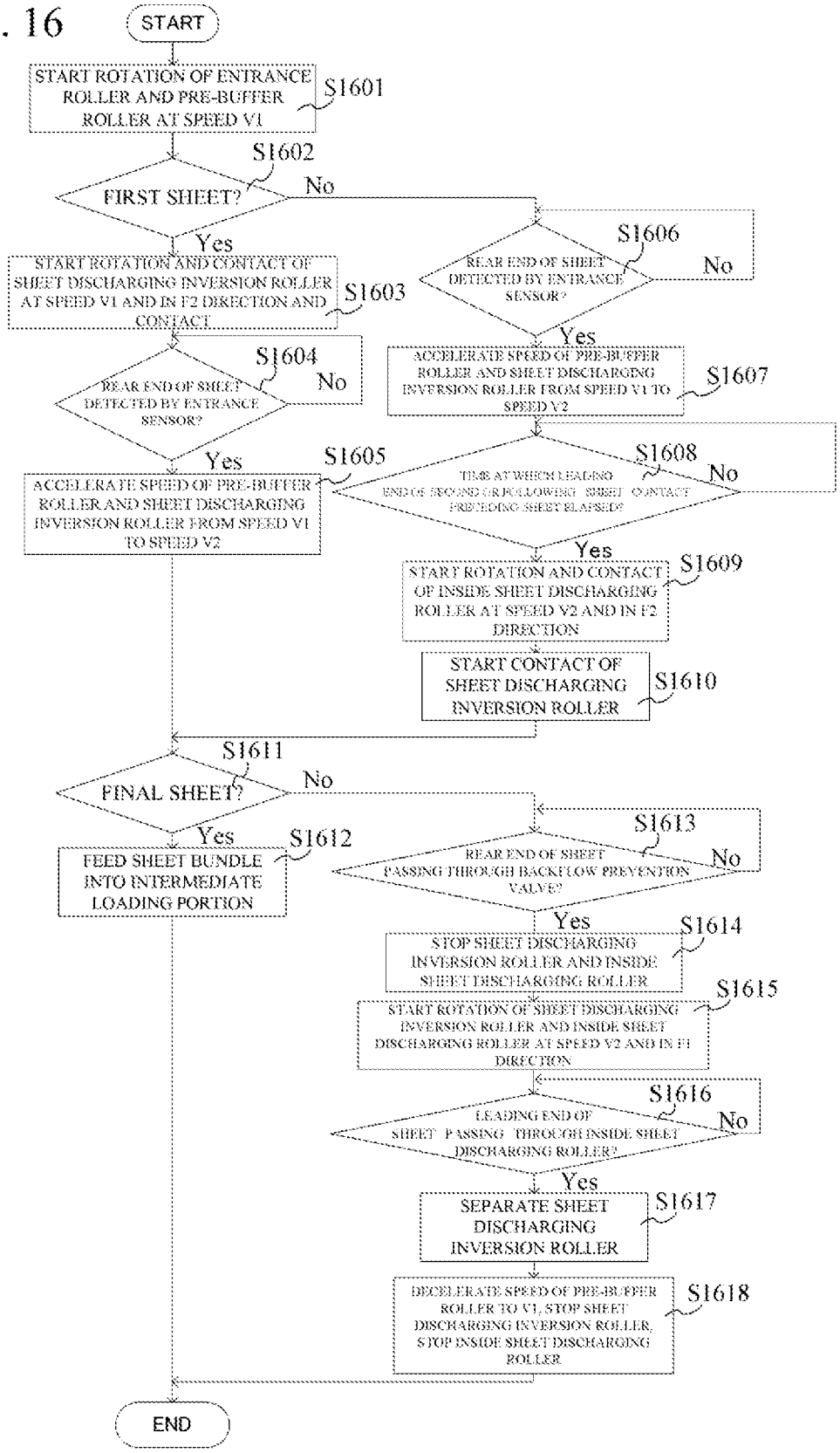
FIG. 16 is a flowchart showing the operation of a sheet post-processing apparatus 4 according to a third embodiment.

FIG. 16 is a control flowchart of a sheet post-processing apparatus 4 according to the present embodiment. The conveyance speed of a horizontal conveyance portion 14 is represented as V1, and the speed of acceleration inside the apparatus of a pre-buffer roller 22, a sheet discharging inversion roller 24, and an inside sheet discharging roller 26 is represented as V2. Sheet conveyance control means 701 starts the rotation of an entrance roller 21 and the pre-buffer roller 22 at a speed V1 (S1601). The sheet conveyance control means 701 determines whether a conveyed sheet S1 is the first sheet of a sheet bundle subjected to buffer processing (S1602). When the sheet S1 is the first sheet (Yes in S1602), the sheet conveyance control means 701 causes the sheet discharging inversion roller 24 to contact the sheet S1 and start rotation at the speed V1 in the direction of a sheet discharging upper tray 25 (hereinafter represented as an F2 direction) (S1603). The sheet conveyance control means 701 waits until the rear end of the sheet S1 passes through an entrance sensor 27 (S1604). After the rear end of the sheet S1 passes through the entrance sensor 27, the sheet conveyance control means 701 accelerates the speed of the pre-buffer roller 22 and the sheet discharging inversion roller 24 to the speed V2 and sets a sheet interval necessary for a switchback at a place between the sheet S1 and a following sheet (S1605). When the conveyed sheet is not a last sheet loaded into a buffer portion (No in S1611), the sheet conveyance control means 701 waits until the rear end of the sheet S1 passes through a backflow prevention valve 23 by a prescribed amount (S1613). When the rear end of the sheet moves by the prescribed amount, the sheet conveyance control means 701 stops the sheet discharging inversion roller 24 and the inside sheet discharging roller 26 (S1614). Next, the sheet conveyance control means 701 starts the rotation of the sheet discharging inversion roller 24 and the inside sheet discharging roller 26 at the speed V2 and in an F1 direction (S1615). The sheet conveyance control means 701 waits until the leading end of the sheet passes through the inside sheet discharging roller 26 (S1616) and separates an inversion upper roller 24*a* (S1617). The sheet S1 stops at a position at which the sheet S1 is conveyed by a prescribed amount from the inside sheet discharging roller 26 (S1618).

When a sheet other than the first sheet is conveyed (No in S1602), the sheet conveyance control means 701 waits until the rear end of the second or following sheet passes through the entrance sensor 27 (S1606). When the rear end of the second or following sheet passes through the entrance sensor 27, the sheet conveyance control means 701 accelerates the speed of the pre-buffer roller 22 and the sheet discharging inversion roller 24 to the speed V2 (S1607). The sheet conveyance control means 701 monitors the elapse of a time at which the leading end of the second or following sheet (for example, a sheet S2) contacts the sheet S1 (S1608). The sheet conveyance control means 701 causes the inside sheet discharging roller 26 to start rotation again at the speed V2 and in the F2 direction toward the sheet discharging inversion roller 24, and the sheet S1 held by the inside sheet discharging roller 26 is conveyed (S1609). At a timing at which the relative speed of the sheet S1 and the relative speed of the sheet S2 become equal, the inversion upper roller 24*a* contacts the sheet S2 in an E2 direction (S1610). When the sheet is not a last sheet loaded into a buffer portion like the first sheet (No in S1611), the sheet conveyance control means 701 performs the processing of S1603 to S1618. When the conveyed sheet is the last sheet loaded into the buffer portion (Yes in S1611), the sheet conveyance control means 701 feeds a sheet bundle into an intermediate loading portion (S1612).

Figure 17A:
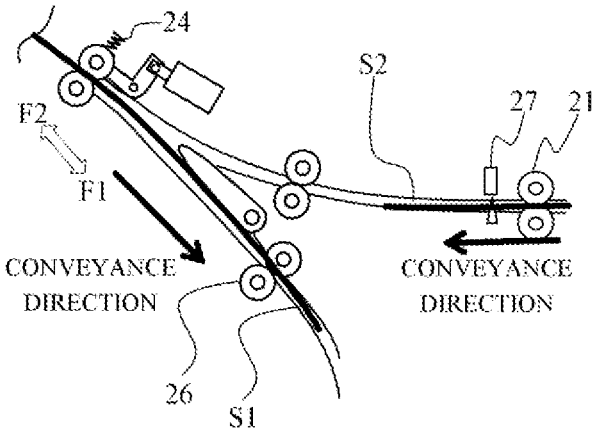
FIGS. 17A to 17E are cross-sectional views showing the state of a sheet bundle subjected to buffer processing according to the third embodiment.
Figure 17B:
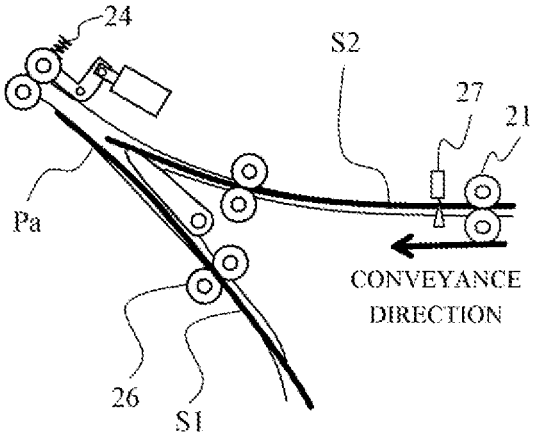
Figure 17C:
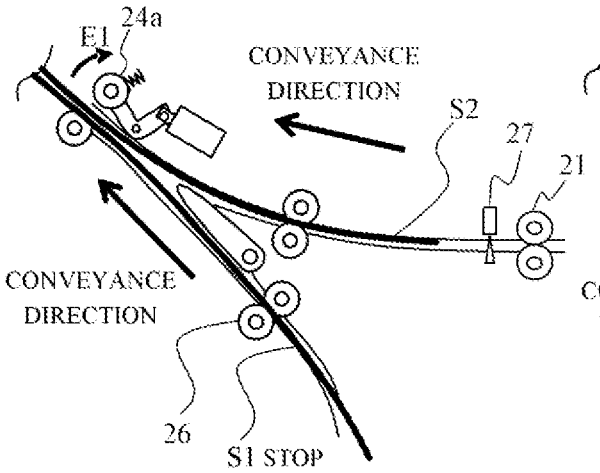
Figure 17D:
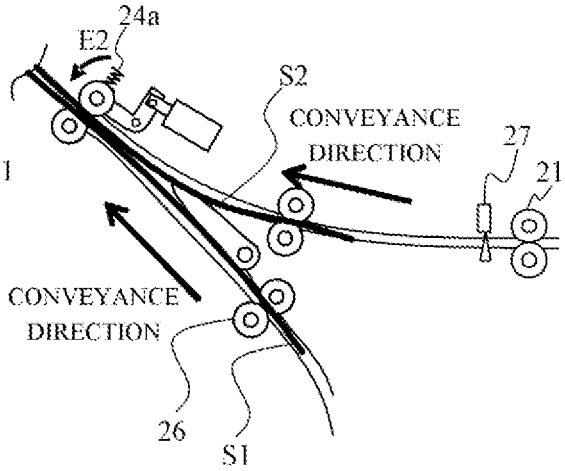
Figure 17E:
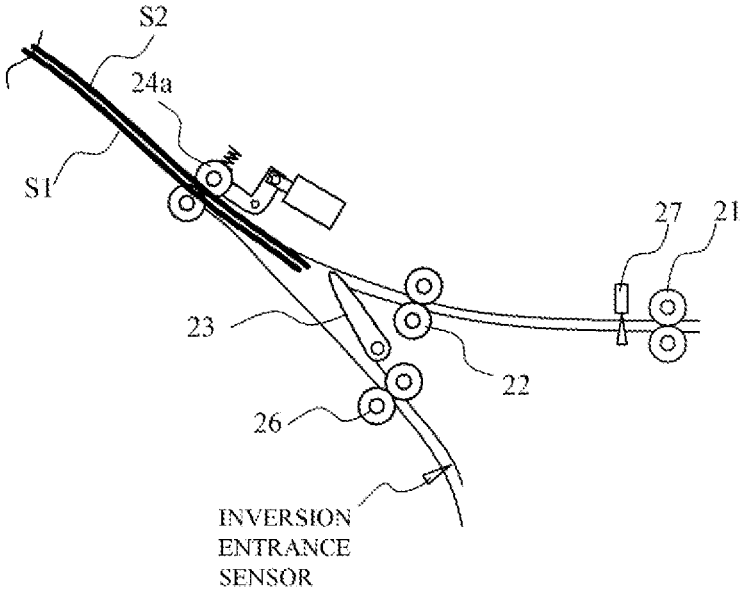
Figure 18A:
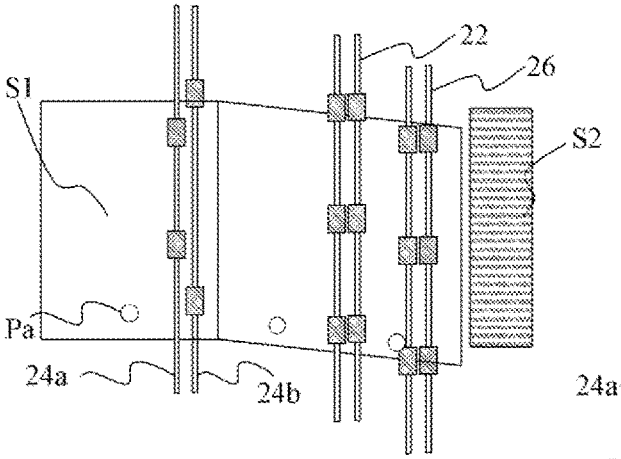
FIGS. 18A to 18E are upper surface views showing the state of a sheet bundle subjected to buffer processing according to the third embodiment.
Figure 18B:
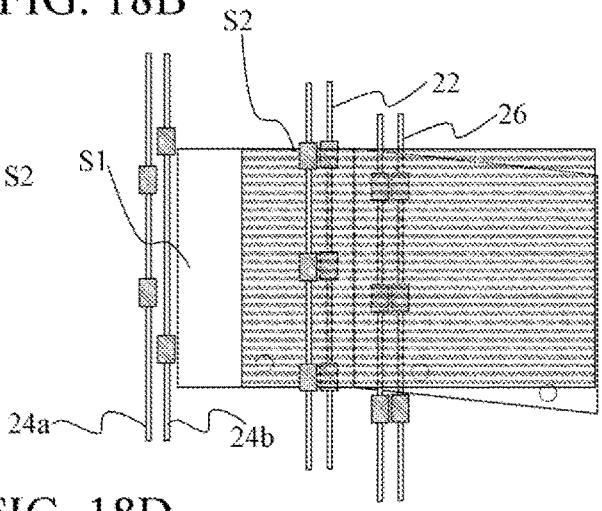
Figure 18C:
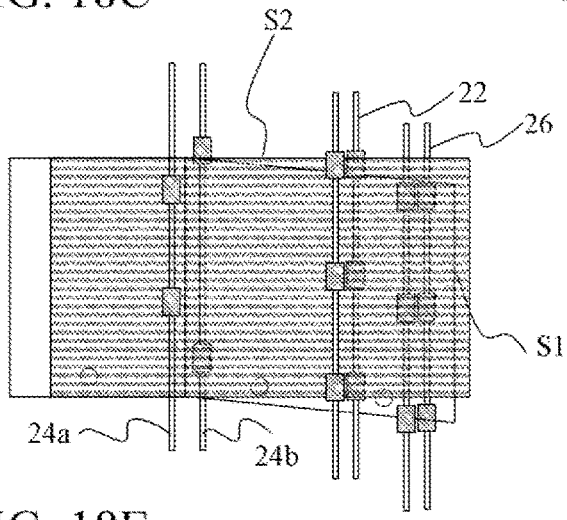
Figure 18D:
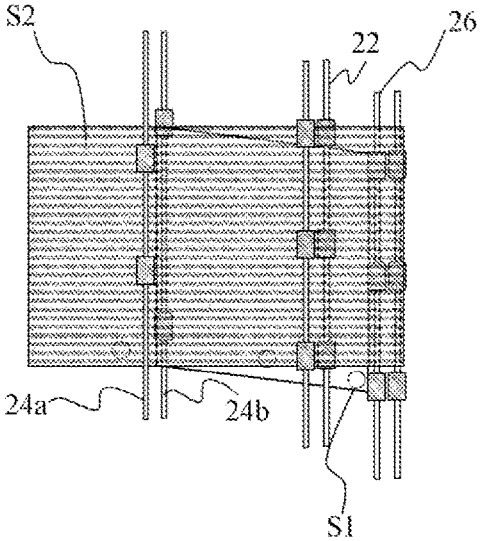
Figure 18E:
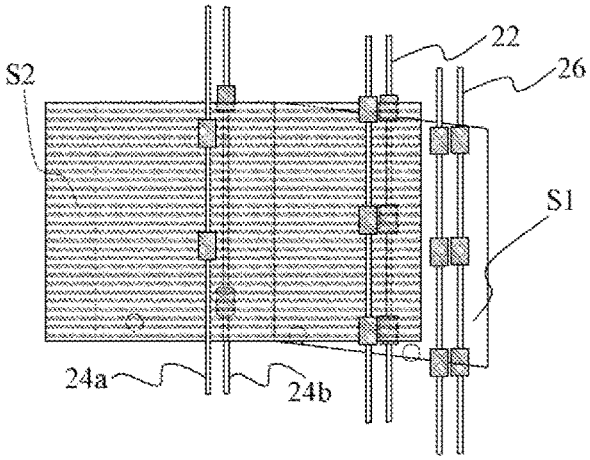

FIGS. 17A to 17E and 18A to 18E are views showing the state of a sheet bundle in the buffer portion of the sheet post-processing apparatus 4 in a case in which the operation processing of FIG. 16 is performed. A sheet S1 is conveyed until the sheet S1 passes through the backflow prevention valve 23 by a prescribed amount via a first conveyance path 91 and caused to switchback by the sheet discharging inversion roller 24, and the leading end of the sheet S1 is held by the inside sheet discharging roller 26 (FIGS. 17A and 18A). When the leading end of the sheet S1 moves by a prescribed amount, the sheet discharging inversion roller 24 and the inside sheet discharging roller 26 are stopped and wait for the conveyance of a following sheet S2 (FIGS. 17B and 18B). At this time, the stop position of the sheet S1 caused to switchback is arranged at a stop position at which the leading end of the subsequently-conveyed sheet S2 is allowed to contact a position closer to a rear end side than a punch hole of the sheet S1. When the following sheet S2 contacts the preceding sheet S1, the preceding sheet S1 is conveyed (FIGS. 17C and 18C) as the inside sheet discharging roller 26 starts rotation again at the speed V2 and in the F2 direction toward the sheet discharging inversion roller 24. Then, at a timing at which the relative speed of the sheet S1 and the relative speed of the sheet S2 become equal, the inversion upper roller 24*a* contacts the sheet S2 in the E2 direction (FIGS. 17D and 18D). The preceding sheet S1 and the following sheet S2 are conveyed by a prescribed amount as they are. As a result, a sheet bundle is formed in which the distance of a deviation between the rear end of the sheet S1 caused to switchback and the leading end of the sheet S2 that are caused to switchback falls within a certain range in a buffer portion (FIGS. 17E and 18E). Note that a sheet bundle in which the leading end of the following sheet S2 overlaps the rear end of the preceding sheet S1 caused to switchback in the conveyance direction is formed during buffer processing in the present embodiment as well. In the present embodiment, when landing on (contacting) the sheet S1, the leading end of the sheet S2 is configured to land on a position closer to a leading end side than the first boring hole of the sheet S1 and avoid the boring hole. By this configuration, the sheet S1 is prevented from being pushed out by the sheet S2. In the present embodiment, the deviation of a relative position is not caused in a direction orthogonal to the conveyance direction of a sheet unlike the first and second embodiments.

As described above, it is possible to form a sheet bundle that is free from an unexpected and sudden deviation while preventing the leading end of a sheet from contacting a boring hole by changing the timing of buffer processing even when the sheet subjected to boring processing is conveyed to the buffer portion according to the present embodiment. The present invention is applicable so long as a relationship in which sheets forming a sheet bundle have different sizes but the leading end of a following sheet contacts a boring hole of a preceding sheet is established. In the present embodiment, buffer processing timing change control to avoid a boring hole is applied to all sheets. However, the buffer processing timing change control to avoid a boring hole may be applied only to a sheet that is easily curled (such as a thin paper and a moisture absorption sheet) or a sheet in which a protruding curl is caused and may not be applied to a sheet that is not curled. Further, a setting like a curled sheet conveyance mode to change an operation when a curled sheet is conveyed may be provided in the image forming system or the sheet post-processing apparatus, and the buffer processing timing change control to avoid a boring hole may be employed only when the setting becomes valid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-217249, filed on Dec. 25, 2020, which is hereby incorporated by reference herein in its entirety.

What is claimed is:

1. A sheet post-processing apparatus that performs post-processing on a sheet on which an image is formed by an image forming apparatus, the sheet post-processing apparatus comprising:

a punch hole forming portion that forms a punch hole on a sheet;

a first conveyance path;

a switchback portion that switches a traveling direction of a sheet on a downstream side of the first conveyance path;

a switchback path through which a sheet caused to switchback by the switchback portion is conveyed; and a second conveyance path that is used to convey a sheet caused to switchback on a downstream side of the switchback path, wherein the switchback portion:

conveys a first sheet caused to switchback by the switchback portion to a position over the switchback path and the second conveyance path and stops the conveyed first sheet, conveys a second sheet to a position partially overlapping the first sheet over the first conveyance path and the switchback path, integrally conveys the first sheet and the second sheet to a position at which the first sheet and the second sheet fall within the switchback path to form a sheet bundle in which the first sheet and the second sheet overlap each other in the switchback path, and makes a shift so that a relative position between the first sheet and the second sheet in a width direction orthogonal to a conveyance direction becomes a relative position at which the second sheet does not overlap a punch hole formed on the first sheet to make the second sheet overlap the first sheet.

2. The sheet post-processing apparatus according to claim 1, wherein the switchback portion shifts the first sheet in the width direction in the switchback path.

3. The sheet post-processing apparatus according to claim 2, wherein the switchback portion shifts the first sheet in one direction in the width direction.

4. The sheet post-processing apparatus according to claim 2, wherein the switchback portion switches a direction to shift the first sheet between one direction and the other direction in the width direction.

5. The sheet post-processing apparatus according to claim 1, wherein a relative position between the first sheet and the second sheet in the conveyance direction is different in the switchback path in a case where the second sheet is overlapped with the first sheet in the conveyance direction.

6. The sheet post-processing apparatus according to claim 1, further comprising:

an intermediate loading portion in which the sheet bundle formed by the switchback portion is loaded via the second conveyance path;

a longitudinal alignment reference plate on which a leading end of a sheet of the sheet bundle loaded into the intermediate loading portion is abutted; and a pressing member that has a contact portion to contact an upper surface of the sheet bundle loaded into the intermediate loading portion and moves the contact portion toward the longitudinal alignment reference plate to apply a force used to press the sheet bundle toward the longitudinal alignment reference plate to the sheet bundle, wherein the switchback portion forms the sheet bundle with the second sheet overlapping the first sheet so as to be deviated from the first sheet on an upstream side of the second conveyance path so that the contact portion contacts an upper surface of the first sheet precedingly to an upper surface of the second sheet in the sheet bundle.

7. The sheet post-processing apparatus according to claim 6, further comprising:

a sheet bundle transverse alignment portion that aligns positions of a plurality of sheets forming the sheet bundle with each other in a transverse direction orthogonal to the conveyance direction inside the intermediate loading portion.

8. A sheet post-processing apparatus that performs post-processing on a sheet on which an image is formed by an image forming apparatus, the sheet post-processing apparatus comprising:

a punch hole forming portion that forms a punch hole on a sheet;

a first conveyance path;

a switchback portion that switches a traveling direction of a sheet on a downstream side of the first conveyance path;

a switchback path through which a sheet caused to switchback by the switchback portion is conveyed; and a second conveyance path that is used to convey a sheet caused to switchback on a downstream side of the switchback path, wherein the switchback portion:

conveys a first sheet caused to switchback by the switchback portion to a position over the switchback path and the second conveyance path and stops the conveyed first sheet, conveys a second sheet to a position partially overlapping the first sheet over the first conveyance path and the switchback path, integrally conveys the first sheet and the second sheet to a position at which the first sheet and the second sheet fall within the switchback path to form a sheet bundle in which the first sheet and the second sheet overlap each other in the switchback path, and sets a stop position of the first sheet at a stop position at which the second sheet overlaps the first sheet while preventing a leading end of the second sheet from contacting a punch hole formed on the first sheet to make the second sheet overlap the first sheet.

9. The sheet post-processing apparatus according to claim 8, wherein, in a case where the second sheet partially overlaps the first sheet over the first conveyance path and the switchback path, a leading end of the second sheet contacts a side closer to a rear end than a punch hole of the first sheet caused to switchback.

* * * * *